US012253082B1

(12) United States Patent
Hopkins et al.

(10) Patent No.: US 12,253,082 B1
(45) Date of Patent: Mar. 18, 2025

(54) SCROLL COMPRESSORS INCLUDING RING-SHAPED COUNTERWEIGHT ASSEMBLIES

(71) Applicant: Copeland LP, Sidney, OH (US)

(72) Inventors: Stephen M. Hopkins, Dayton, OH (US); Zhe Lin, Troy, OH (US)

(73) Assignee: Copeland LP, Sidney, OH (US)

( * ) Notice: Subject to any disclaimer, the term of this patent is extended or adjusted under 35 U.S.C. 154(b) by 0 days.

(21) Appl. No.: 18/602,626

(22) Filed: Mar. 12, 2024

(51) Int. Cl.
*F04C 18/02* (2006.01)
*F04C 29/00* (2006.01)

(52) U.S. Cl.
CPC ..... *F04C 18/0215* (2013.01); *F04C 29/0021* (2013.01); *F04C 29/005* (2013.01); *F04C 2230/605* (2013.01); *F04C 2240/60* (2013.01); *F04C 2240/807* (2013.01)

(58) Field of Classification Search
CPC ..... F04C 18/02–0292; F04C 2240/807; F04C 2230/605; F04C 29/005; F04C 29/0021; F04C 2240/60; H02K 7/04; H02K 15/165
See application file for complete search history.

(56) References Cited

U.S. PATENT DOCUMENTS

| | | | | |
|---|---|---|---|---|
| 5,064,356 | A * | 11/1991 | Horn | F04C 29/028 418/55.6 |
| 5,597,293 | A * | 1/1997 | Bushnell | F16F 15/28 417/410.3 |
| 8,974,198 | B2 | 3/2015 | Schaefer et al. | |
| 8,992,188 | B2 | 3/2015 | Nakamura et al. | |
| 10,539,139 | B2 | 1/2020 | Noro et al. | |
| 11,566,622 | B2 | 1/2023 | Jin et al. | |
| 2017/0089341 | A1* | 3/2017 | Takamura | F04C 23/008 |
| 2017/0268515 | A1* | 9/2017 | Doepker | F04C 18/0215 |
| 2022/0178371 | A1 | 6/2022 | Lee et al. | |

FOREIGN PATENT DOCUMENTS

| | | | | |
|---|---|---|---|---|
| CN | 212774762 | U | 3/2021 | |
| CN | 217761308 | U | 11/2022 | |
| CN | 115514143 | A | 12/2022 | |
| CN | 117570023 | A * | 2/2024 | |
| EP | 2913531 | A1 * | 9/2015 | F04C 18/0215 |
| JP | 2014070586 | A * | 4/2014 | |
| KR | 100565234 | B1 * | 3/2006 | |
| WO | 2005040610 | A1 | 5/2005 | |

* cited by examiner

*Primary Examiner* — Mark A Laurenzi
*Assistant Examiner* — Xiaoting Hu
(74) *Attorney, Agent, or Firm* — Armstrong Teasdale LLP

(57) ABSTRACT

A compressor includes a shell, a non-orbiting scroll disposed within the shell, an orbiting scroll disposed within the shell and meshed with the non-orbiting scroll, a driveshaft operable to drive the orbiting scroll relative to the non-orbiting scroll, and a ring-shaped counterweight assembly positioned on the driveshaft. The counterweight assembly has two radial surfaces and a circumferential edge between the two radial surfaces, and the counterweight assembly includes a counterweight fixed on the driveshaft and a cover attached to one of the counterweight and the driveshaft via a snap fit connection. The counterweight and the cover cooperate to define the counterweight assembly.

13 Claims, 35 Drawing Sheets

SCROLL COMPRESSORS INCLUDING RING-SHAPED COUNTERWEIGHT ASSEMBLIES

FIELD

The field relates generally to scroll compressors, and more particularly, to ring-shaped counterweight assemblies for use with a scroll compressor that facilitate reducing drag and windage from working fluid.

BACKGROUND

Scroll compressors compress refrigerant using a scroll assembly including a non-orbiting scroll and an orbiting scroll that cooperate to form sealed pockets therebetween. A drive shaft is connected to the orbiting scroll for causing the orbiting scroll to move relative to the non-orbiting scroll. During operation of the scroll compressor, motion of the orbiting scroll relative to the non-orbiting scroll continuously changes the volume of the sealed pockets to compress refrigerant within.

Scroll compressors may include counterweights on the driveshaft and/or a rotor that facilitate reducing loads on bearings and/or balancing inertial forces of the moving components of the scroll compressor. The counterweights may work against fluid (e.g., oil or high pressure refrigerant) in the scroll compressor, creating the propensity for drag and windage on the counterweights which negatively impacts operational efficiency of the scroll compressor.

There is an ongoing need for improvements of counterweight assemblies that are used in scroll compressors to facilitate reducing or eliminating the negative impact that drag and windage on the counterweights has on operational efficiency. Additionally, there is a need to facilitate such improvements in operational efficiency while also improving the manufacturability, installation, and other aspects of the counterweight assemblies.

This background section is intended to introduce the reader to various aspects of art that may be related to various aspects of the present disclosure, which are described and/or claimed below. This discussion is believed to be helpful in providing the reader with supporting information to facilitate a better understanding of the various aspects of the present disclosure. Accordingly, it should be understood that these statements are to be read in this light, and not as admissions of prior art.

SUMMARY

One aspect is a compressor. The compressor includes a shell, a non-orbiting scroll disposed within the shell, an orbiting scroll disposed within the shell and meshed with the non-orbiting scroll, a driveshaft operable to drive the orbiting scroll relative to the non-orbiting scroll, and a ring-shaped counterweight assembly positioned on the driveshaft. The counterweight assembly has two radial surfaces and a circumferential edge between the two radial surfaces, and the counterweight assembly includes a counterweight fixed on the driveshaft and a cover attached to one of the counterweight and the driveshaft via a snap fit connection. The counterweight and the cover cooperate to define the counterweight assembly.

Another aspect is a subassembly for a scroll compressor. The subassembly includes a driveshaft, a first counterweight assembly positioned proximate a first end portion of the driveshaft, and a second counterweight assembly positioned proximate a second end portion of the driveshaft. Each counterweight assembly is ring-shaped, having two radial surfaces and a circumferential edge between the two radial surfaces, and each counterweight assembly includes a counterweight fixed on the driveshaft and a cover attached to one of the counterweight and the driveshaft via a snap fit connection. The counterweight and the cover cooperate to define the respective counterweight assembly. For each counterweight assembly, the counterweight includes a coupling ring and a main weight extending from the coupling ring, the coupling ring defining a bore sized and shaped to receive the driveshaft to fix the counterweight on the driveshaft, the main weight has a semi-circular shape with two circumferential counterweight end surfaces, and the cover extends circumferentially between two cover end surfaces each positioned adjacent one of the counterweight end surfaces.

Another aspect is a method of assembling a compressor. The method includes positioning a non-orbiting scroll within a shell of the compressor; positioning an orbiting scroll within the shell such that the orbiting scroll is meshed with the non-orbiting scroll; operably connecting a driveshaft to the orbiting scroll; and positioning a ring-shaped counterweight assembly on the driveshaft by fixing a counterweight on the driveshaft and attaching a cover to one of the counterweight and the driveshaft using a snap fit connection, wherein the counterweight and cover cooperate to define the counterweight assembly.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

FIG. 25 is an isolated perspective of another one of the counterweight assemblies of FIG. 10;

Corresponding reference characters indicate corresponding parts throughout the drawings.

DETAILED DESCRIPTION

Figure 1:
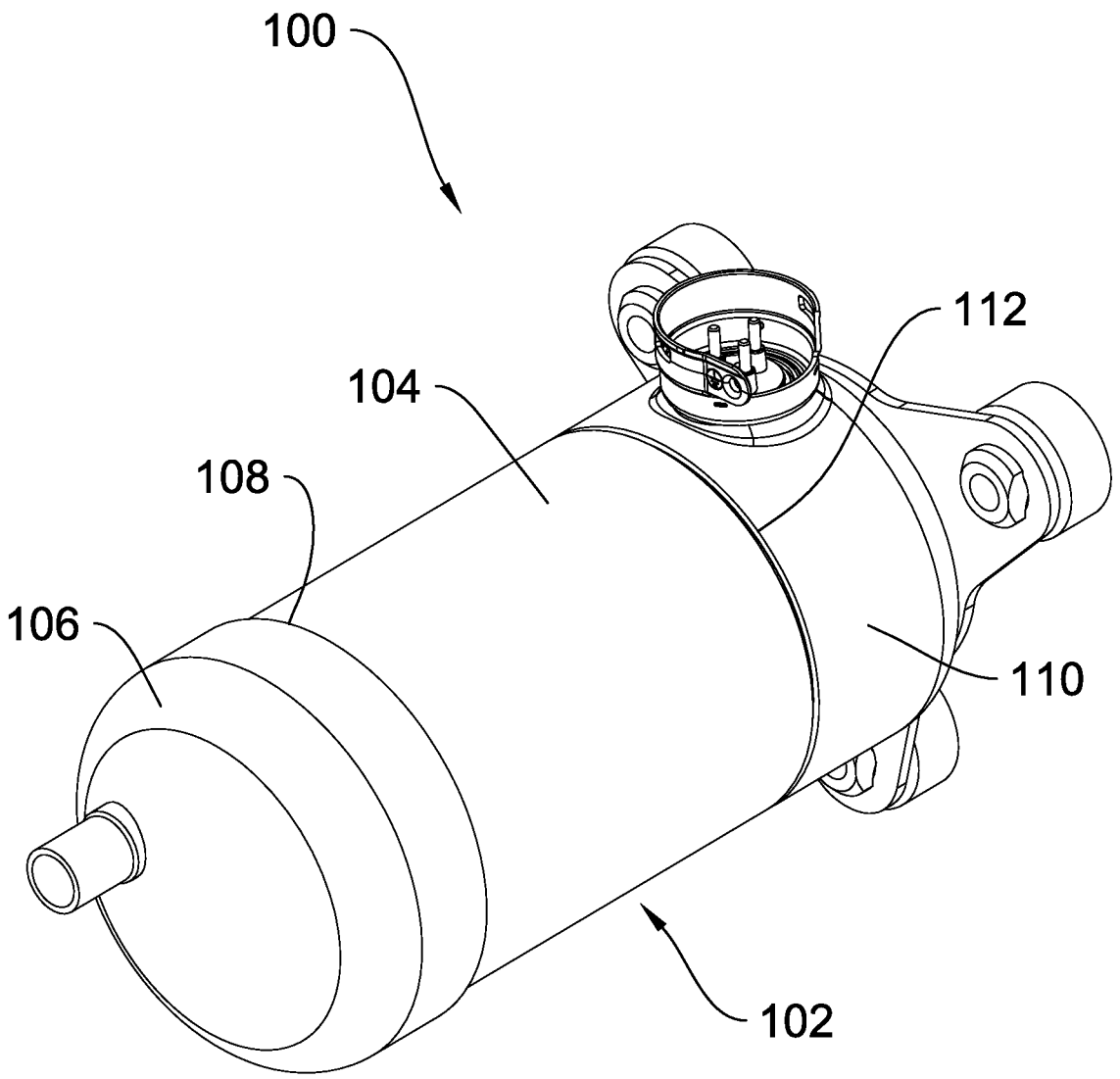
FIG. 1 is a perspective view of a compressor of one embodiment.
Figure 2:
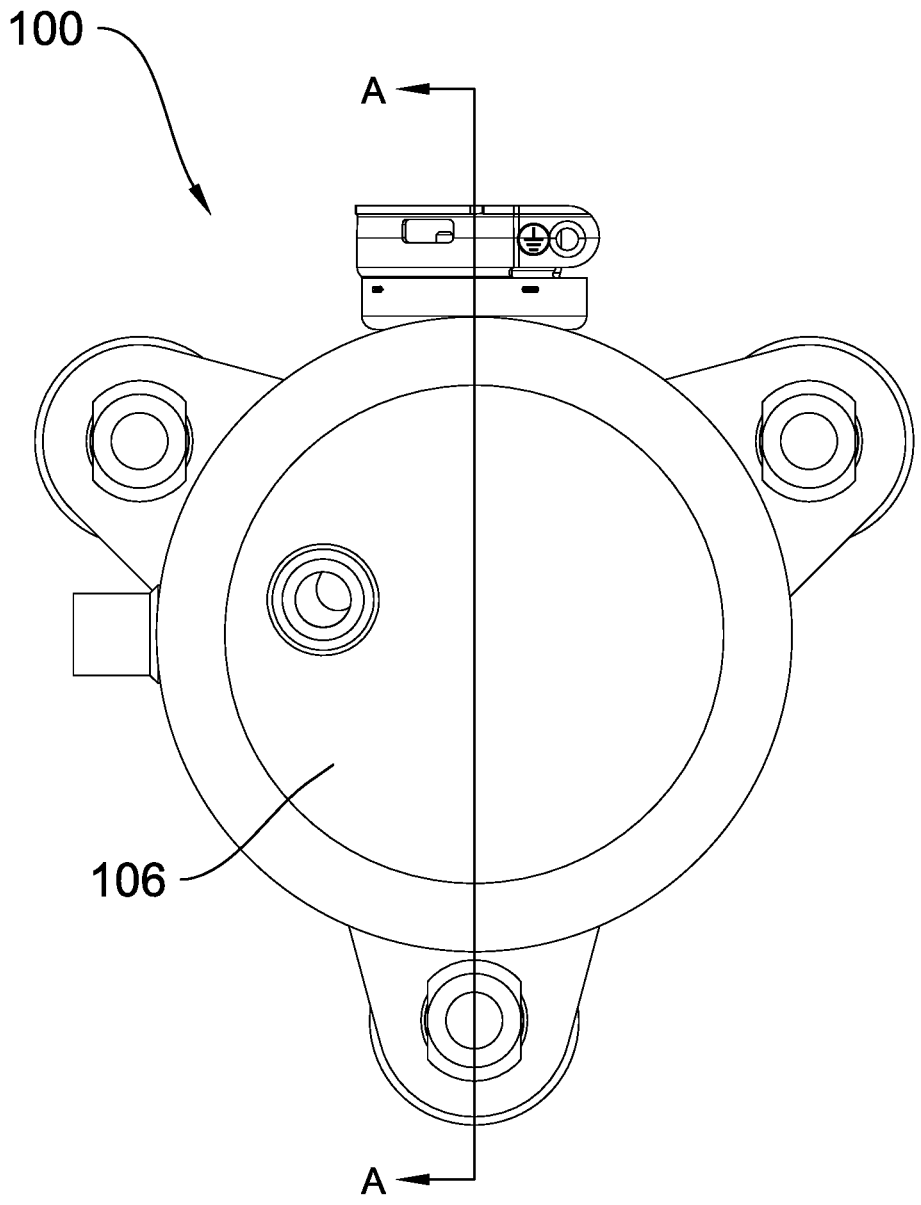
FIG. 2 is a top view of the compressor.
Figure 3:
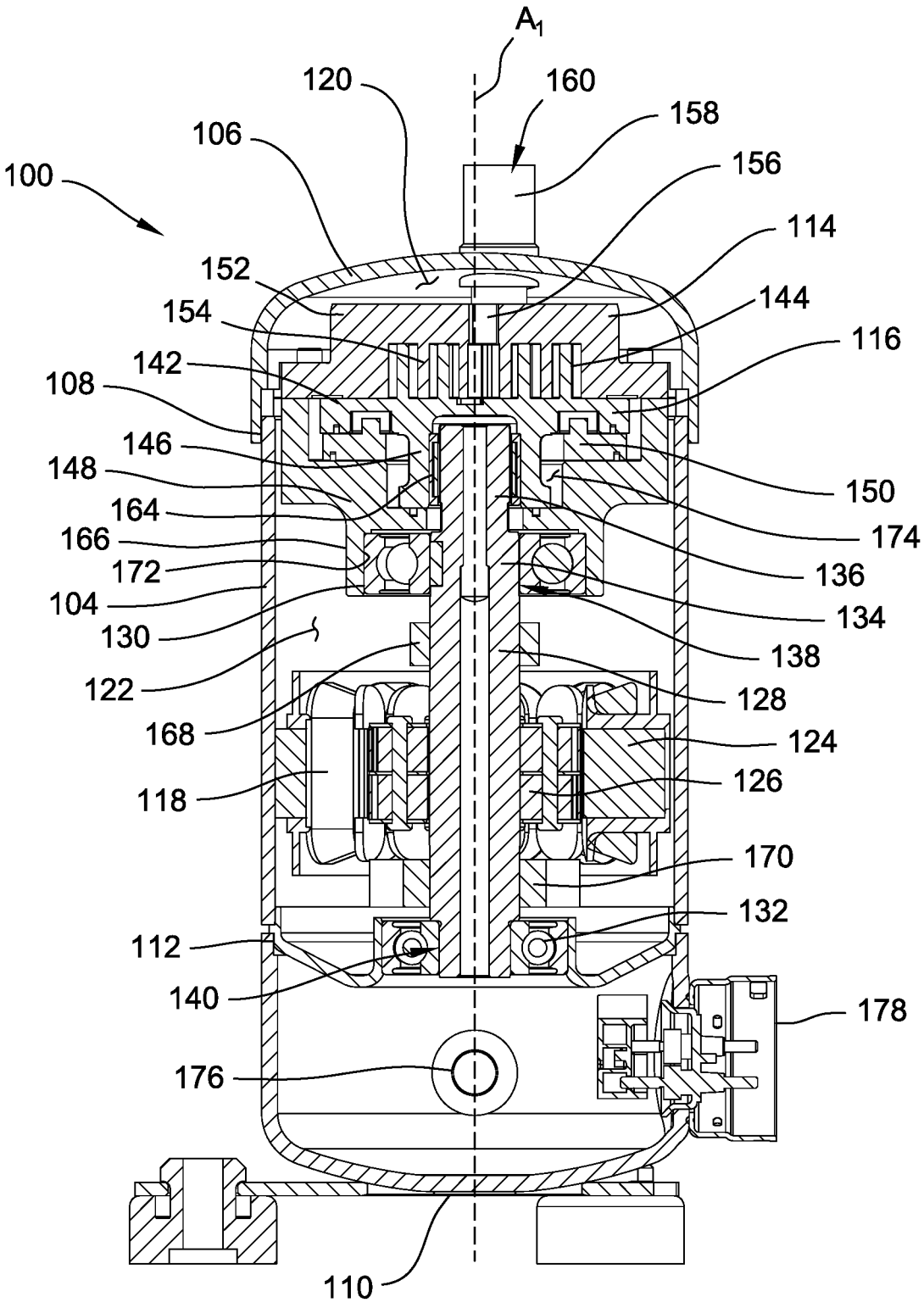
FIG. 3 is a cross-sectional view of the compressor shown in FIGS. 1 and 2 taken along line A-A, illustrating a first seal configuration of the compressor.

Referring to FIGS. 1-3, a compressor, in this example a scroll compressor, is indicated generally at 100. The compressor 100 (e.g., a high-side compressor) includes a compressor housing 102 forming at least one sealed cavity within which refrigerant compression is accomplished. The compressor housing 102 includes a shell 104, an end cap in 106 positioned at a first end 108 of the shell 104, and a base 110 positioned at an opposing second end 112 of the shell 104. The scroll compressor 100 may have any suitable scroll compressor design, such as a floating orbit design, a floating non-orbit design, a floating fixed scroll design, a co-rotating design, or another suitable scroll compressor design.

The compressor 100 includes a non-orbiting scroll 114 and an orbiting scroll 116 operably engaged with a motor assembly 118. The end cap 106 and the non-orbiting scroll 114 at least partially define a first chamber 120. In some embodiments, at least a portion of the shell 104 and/or a muffler plate (not shown) at least partially defines the first chamber 120. The shell 104 at least partially defines a second chamber 122. The motor assembly 118 includes a motor stator 124 and a rotor 126. The compressor 100 also includes a driveshaft 128 that may be press fit within the rotor 126. The rotor 126 transmits rotational power to the driveshaft 128. The motor assembly 118 may be a variable-speed motor for rotating the driveshaft 128 at any of a plurality of speeds. Alternatively, the motor assembly 118 may be a fixed-speed motor. In the example compressor 100, the motor assembly 118 is positioned within the shell 104. For example, as shown in FIG. 3, the motor assembly 118 is positioned within the second chamber 122. The compressor 100 may alternatively be an open drive compressor driven by a motor assembly that is positioned outside of the compressor housing 102.

The compressor 100 also includes a first bearing assembly 130 and a second bearing assembly 132 that rotationally support the driveshaft 128. The first bearing assembly 130 and/or the second bearing assembly 132 include rolling element bearings having an inner ring defining a bearing surface and bearing opening for receiving the driveshaft 128, an outer ring spaced radially outward from the inner ring, and a plurality of balls or rollers disposed between the inner ring and the outer ring. The driveshaft 128 is rotationally supported by the rolling element bearings of the bearing assembly 130 and/or 132 such that the driveshaft 128 rotates with the inner ring. Alternatively, in some embodiments, the first bearing assembly 130 and/or the second bearing assembly 132 include journal bearings, and the driveshaft 128 is rotationally supported by the journal bearings within a bearing opening and relative to a stationary bearing inner surface. The first bearing assembly 130 and/or the second bearing assembly 132 may include any suitable bearing type.

The driveshaft 128 includes a driveshaft body 134 defining a longitudinal axis $A_1$. An axial direction of the compressor 100 includes a direction aligned with, and/or parallel to, the longitudinal axis $A_1$. A radial direction of the compressor 100 includes a direction that is radial relative to the longitudinal axis $A_1$ and perpendicular to the longitudinal axis $A_1$. The driveshaft 128 also includes an eccentric body 136 that is offset from the driveshaft body 134, that is, the eccentric body defines a longitudinal axis that is offset from the longitudinal axis $A_1$. The driveshaft body 134 and the eccentric body 136 are cylindrical in shape. The driveshaft body 134 includes a first end portion 138 and second end portion 140 rotatably supported by the first and second bearing assemblies 130, 132, respectively. The eccentric body 136 may extend from the first end portion 138 of the driveshaft 128.

For case of description and to provide a frame of reference for the compressor 100, elements and components of the compressor 100 may be described as extending "upward," or as extending "downward." The directional terms "upward" and "downward" are relative to the axis $A_1$ defined by the driveshaft 128 when the compressor 100 is assembled and oriented as shown in FIG. 3. These phrases are descriptive and used solely for ease and clarity in describing the compressor 100 as illustrated. Similarly, directional terms such as "axial," "radial," "circumferential", "outer," "peripheral," "outward," "upper," "lower," "top," "bottom," "inner," "inward," and the like are used solely for descriptive purposes. These terms should not be construed as limiting in any sense with regard to a particular orientation of the compressor 100 and the elements and components of the compressor 100.

The orbiting scroll 116 includes an endplate 142 and a spiral wrap 144 extending upward from the endplate 142. The orbiting scroll 116 may further include a cylindrical hub 146 that projects downward from the endplate 142, in an opposite axial direction from the spiral wrap 144. The cylindrical hub 146 interfaces with a main bearing housing 148. The cylindrical hub 146 includes a drive bearing 164. The eccentric body 136 of the driveshaft 128 is drivingly engaged to the drive bearing 164 of the cylindrical hub 146, and the drive bearing 164 transmits rotational motion from the eccentric body 136 to the orbiting scroll 116.

The non-orbiting scroll 114 includes an end plate 152 and a spiral wrap 154 projecting downward from the end plate 152. The spiral wrap 154 may engage (or mesh) with the spiral wrap 144 of the orbiting scroll 116, e.g., by meshing engagement of the wraps 144, 154 with one another, thereby creating a series of moving fluid pockets. The fluid pockets defined by the spiral wraps 144, 154 may decrease in volume as they move from a radially outer position (e.g., at a suction pressure) to a radially inner position (e.g., at a discharge pressure that is higher than the suction pressure) throughout a compression cycle. The end plate 152 may include a discharge passage 156, that is in communication with at least one of the fluid pockets at the radially inner position and allows compressed working fluid, such as refrigerant or a mixture of refrigerant and lubricant, (at or near the discharge pressure) to flow therethrough and into the chamber 120.

The main bearing housing 148 is positioned within the shell 104 and is fixed relative to the compressor housing 102. For example, the main bearing housing 148 may be inserted (e.g., pressed) into the shell 104 of the compressor housing 102 and fixed therein via a press fit. At least a portion of the main bearing housing 148 may partially define a boundary between the chamber 120 and the chamber 122.

The non-orbiting scroll 114 may be connected to the main bearing housing 148. The main bearing housing 148 includes a cylindrical hub 166 defining a cavity 172 facing the chamber 122 that is sized and shaped to receive the first bearing assembly 130 therein. The main bearing housing 148 and first bearing assembly 130 may cooperate to support the driveshaft 128 for rotational motion relative thereto. The main bearing housing 148 also includes a cavity 174 facing the chamber 120 that is sized and shaped to receive the cylindrical hub 146 of the orbiting scroll 116. The main bearing housing 148 may include a thrust surface that supports the cylindrical hub 146 in the cavity 174, and more particularly provides axial support for orbital motion of the orbiting scroll 116 relative to the main bearing housing 148, with the drive bearing 164 positioned between the thrust surface and the cylindrical hub 146.

A coupling 150, such as an Oldham coupling, may be engaged with the orbiting scroll 116 and the non-orbiting scroll 114, or the main bearing housing 148, to prevent relative rotation therebetween.

The compressor 100 also includes two counterweights 168, 170. The counterweights 168, 170 are positioned on the driveshaft 128 in this example. In some examples, the counterweights 168 and/or 170 are positioned on the rotor 126. A first counterweight 168 is positioned proximate the first end portion 138 of the driveshaft body 134 and a second counterweight 170 is positioned proximate the second end portion 140 of the driveshaft body 134. The counterweights 168, 170 facilitate reducing loads on the first and second bearing assemblies 130, 132 and rotationally balancing the driveshaft 128. The counterweights 168, 170 also facilitate counteracting inertial forces or balancing a sum of inertial forces of the moving components of the compressor 100, for example, the orbiting scroll 116, the drive bearing 164, and the eccentric body 136.

An inlet fitting 158 is positioned on the compressor housing 102 and defines an inlet 160 for drawing the working fluid into the fluid pockets defined by the spiral wrap 154 and the spiral wrap 144, where the working fluid is compressed. In the example compressor 100, the inlet fitting 158 is positioned on the end cap 106. After the working fluid is compressed, the compressed working fluid exits the fluid pocket defined by the spiral wrap 154 and the spiral wrap 144 through the discharge passage 156 and into chamber 120. The compressed working fluid flows from the chamber 120 into chamber 122 through one or more passages between the non-orbiting and orbiting scrolls 114, 116, and the shell 104. The compressed working fluid exits the chamber 122 through a discharge fitting 176. The discharge fitting 176 may be attached to the base 110 of the compressor housing 102. A discharge valve assembly, not shown, may be positioned within the discharge fitting 176 and may generally prevent a reverse flow condition through the discharge fitting 176. A hermetic terminal 178 may be attached to the compressor housing 102 at the base 110.

Figure 4:
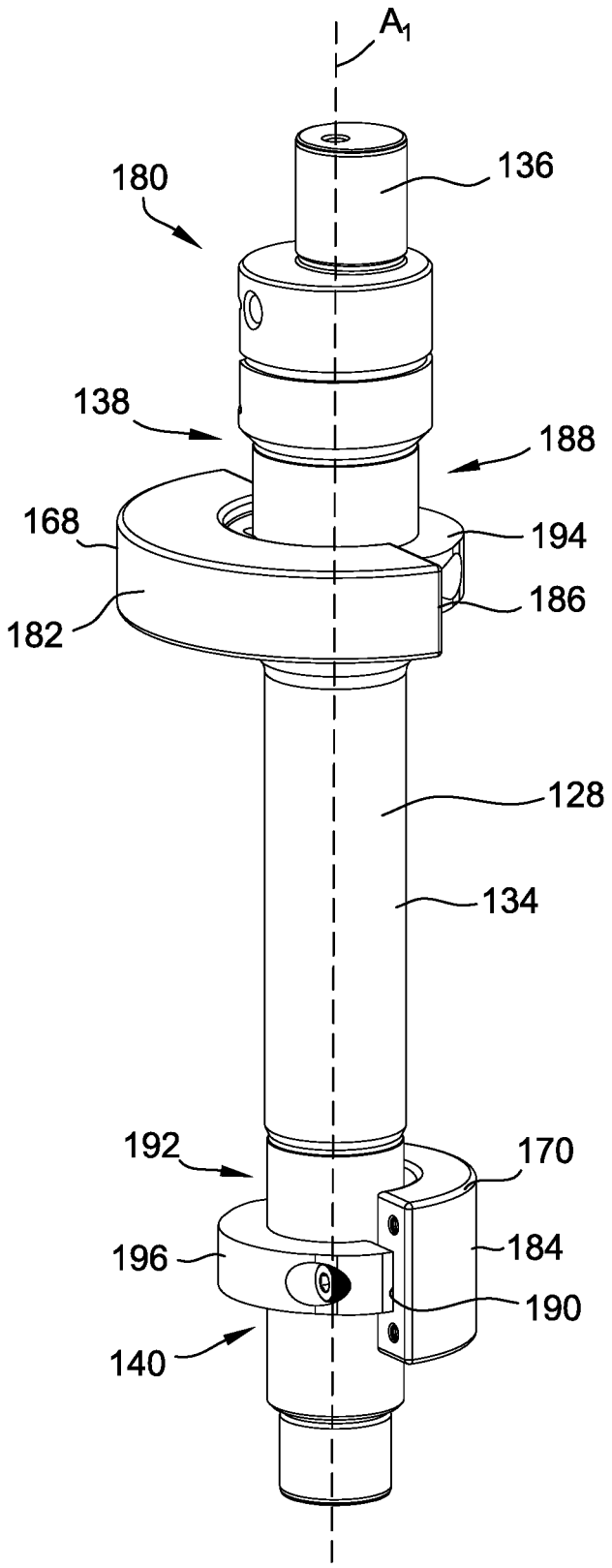
FIG. 4 is an isolated perspective of a subassembly of the compressor including two counterweights and a driveshaft.

FIG. 4 is an isolated perspective of the driveshaft 128 and the two counterweights 168, 170 positioned on the driveshaft 128 respectively proximate the first and second end portions 138, 140. The driveshaft 128 and the two counterweights 168, 170 may be referred to as a subassembly 180 of the compressor 100. Each counterweight 168, 170 includes a semi-circular section 182, 184, or main weight 182, 184. The main weights 182, 184 primarily define the mass characteristics of the counterweights 168, 170. The counterweights 168, 170 may have any suitable mass characteristics to enable the counterweights 168, 170 to function as described, and the mass characteristics vary depending on the intended application of the compressor 100 as well as the degree of balancing and load reduction required or desired from the counterweights 168, 170. The main weights 182, 184 are each sized and shaped according to a desired or pre-defined mass for the counterweight 168, 170. The main weights 182, 184 may have the same or different mass characteristics and, in this regard, the main weights 182, 184 may have the same or a different size and/or shape.

Each main weight 182, 184 is semi-circular and extends circumferentially between two circumferential counterweight end surfaces. The main weight 182 of the first counterweight 168 extends between a first circumferential end surface 186 and a second circumferential end surface 188 (obscured by the driveshaft 128 in FIG. 4). The main weight 184 of the second counterweight 168 extends between a first circumferential end surface 190 and a second circumferential end surface 192 (obscured by the driveshaft 128 in FIG. 4). Each main weight 182, 184 has an arc length between the first circumferential end surface 186, 190 and the second circumferential end surface 188, 192 of up to, but not exceeding, 180°, such that each weight 182, 184 is disposed entirely on one side of a plane extending along the axis $A_1$ of the driveshaft body 134. The main weights 182 and 184 are also disposed on opposite sides of the plane extending along the axis $A_1$.

Each counterweight 168, 170 also includes a coupling ring 194, 196 to fix the counterweight 168, 170 to the driveshaft 128. The coupling ring 194 extends circumferentially beyond the circumferential end surfaces 186, 188 of the main weight 182 and the coupling ring 196 extends circumferentially beyond the circumferential end surfaces 190, 192, such that each coupling ring 194, 196 has a circumferential extent exceeding an arc length of 180°. In the example counterweights 168, 170, the coupling rings 194, 196 extend 360° to surround the driveshaft 128 at the respective location at which the counterweight 168, 170 is positioned. The coupling rings 194, 196 each define a bore (not shown in FIG. 4) that receives the driveshaft 128 and fix the counterweights 168, 170 on the driveshaft 128. The coupling rings 194, 196 fix the counterweights 168, 170 on the driveshaft 128 such that the counterweights 168, 170 rotate with the driveshaft 128.

Figure 5:
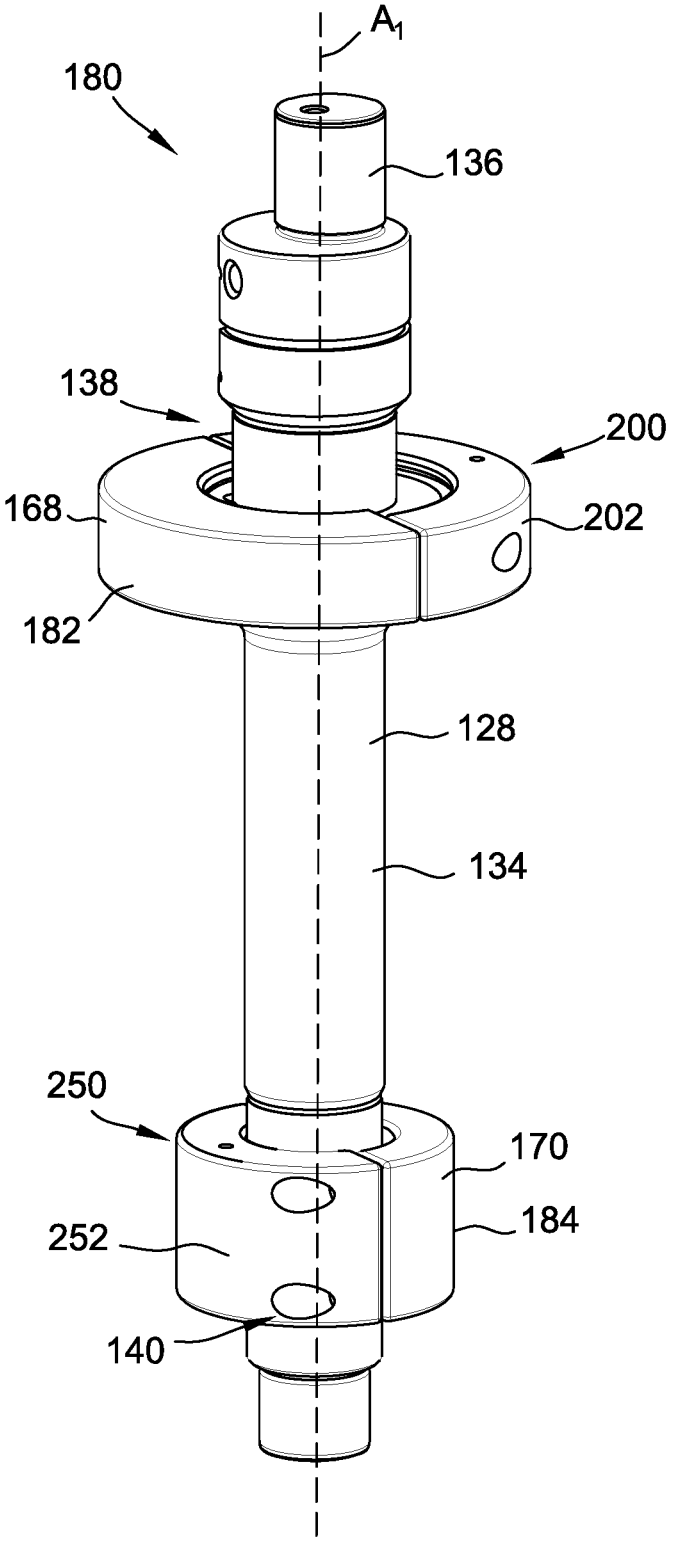
FIG. 5 is an isolated perspective of the subassembly shown in FIG. 4 with covers included with the counterweights to form two counterweight assemblies.

The circumferential end surfaces 186, 188 and 190, 192 create the propensity for drag and windage on the counterweight 168, 170 from fluid (e.g., compressed working fluid) in the chamber 122. Referring to FIG. 5, the compressor 100 also includes covers 202, 252 that respectively cooperate with the counterweights 168, 170 to define ring-shaped counterweight assemblies 200, 250 positioned on the driveshaft 128. In this description, "ring-shaped" refers to a generally annular or circular shape when viewed along the axis $A_1$. The counterweight assemblies 200, 250 can have various configurations and be of any geometric shape that is capable of forming such a ring-shape of the counterweight assembly. For example, a first counterweight assembly 200 is disk-shaped, which is one example of a ring-shaped counterweight assembly. A second counterweight assembly 250 is cylindrically-shaped, which is another example of a ring-shaped counterweight assembly.

A first cover 202 cooperates with the first counterweight 168 to define the first ring-shaped (e.g., disk-shaped) counterweight assembly 200 (described in more detail below with reference to FIGS. 6 and 7) and a second cover 252 cooperates with the second counterweight 170 to define the second ring-shaped (e.g., cylindrically-shaped) counterweight assembly 250 (described in more detail below with reference to FIGS. 8 and 9). The ring-shape of the counterweight assemblies 200, 250 form rotating annular structures on the driveshaft 128 when the compressor 100 is in operation, which facilitates reducing or eliminating the windage and drag effects that fluid in the chamber 122 may otherwise create on the counterweight 168, 170. In particular, the covers 202, 252 that cooperate with the counterweight 168, 170 to define the ring shape of the counterweight assemblies 200, 250 reduce or eliminate drag or windage forces from fluid in the chamber 122 that otherwise act on exposed surfaces (e.g., the circumferential end surfaces 186, 188 and 190, 192) of the counterweights 168, 170.

Figure 6:
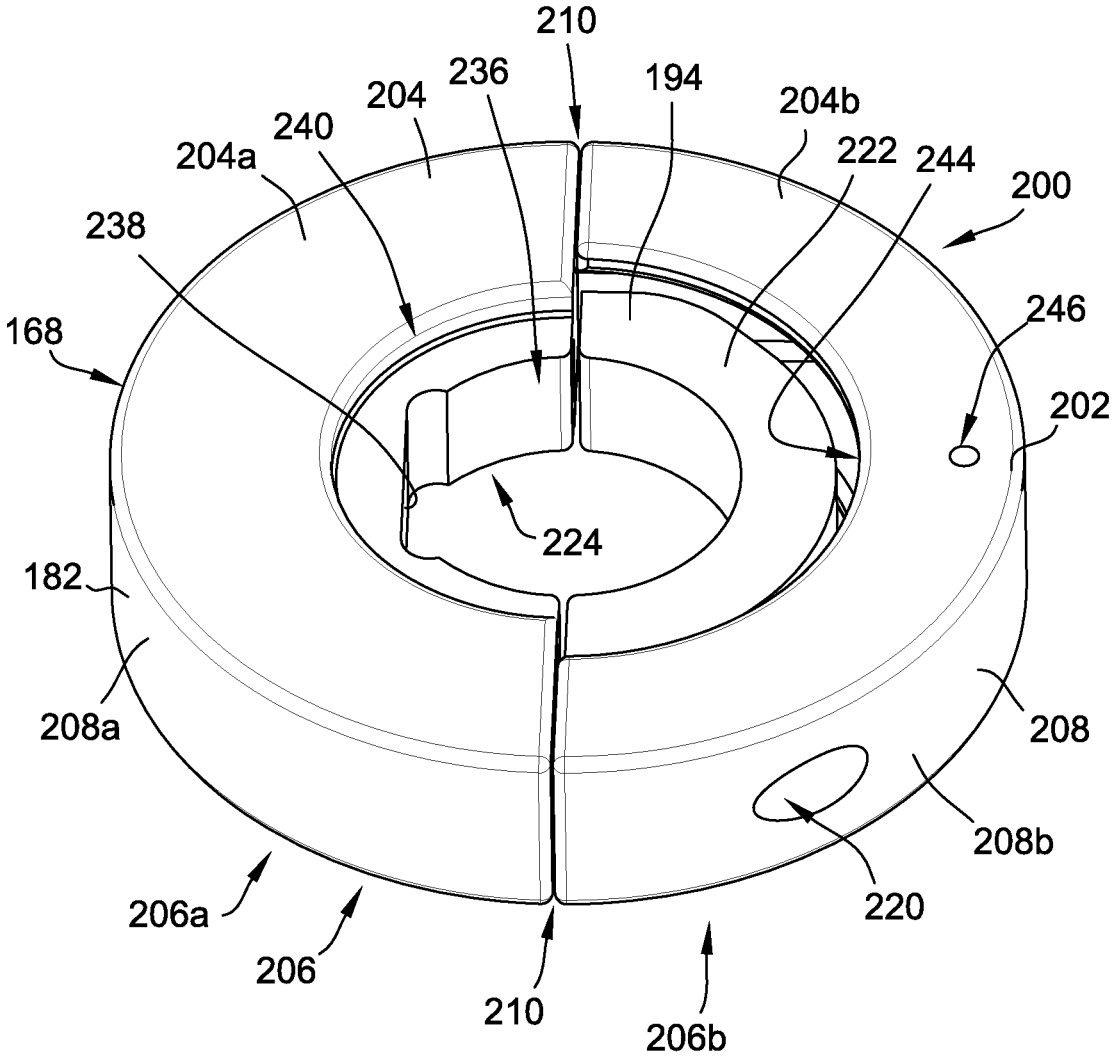
FIG. 6 is an isolated perspective of one of the counterweight assemblies of FIG. 5.
Figure 7:
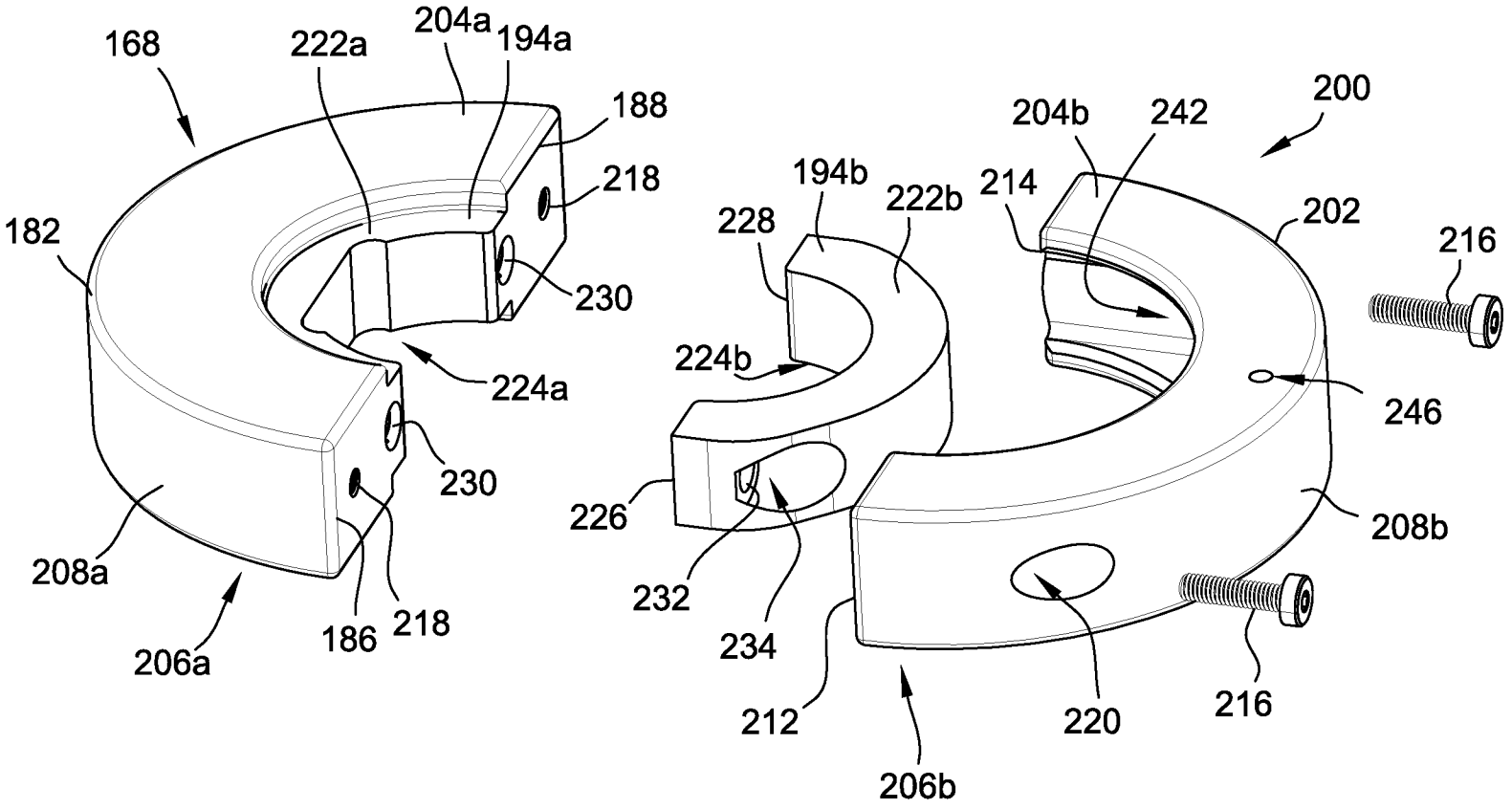
FIG. 7 is an exploded view of the counterweight assembly of FIG. 6.

Referring to FIGS. 6 and 7, the first ring-shaped counterweight assembly 200 includes two radial surfaces 204, 206 and a circumferential edge 208 between the two radial surfaces 204, 206. The radial surfaces 204, 206 are each segmented into a first radial surface 204*a*, 206*a* and a second radial surface 204*b*, 206*b*. The first radial surfaces 204*a*, 206*a* are defined by the main weight 182 of the first counterweight 168 and the second radial surfaces 204*b*, 206*b* are defined by the cover 202. The circumferential edge 208 is also segmented into a first circumferential edge 208*a*, defined by the main weight 182, and a second circumferential edge 208*b*, defined by the cover 202. The main weight 182 and the cover 202 each has a half-disk shape that defines a disk-shape of the first counterweight assembly 200. The main weight 182 and cover 202 are also complementary in size such that the first radial surface 204*a* is substantially flush with the second radial surface 204*b*, the first radial surface 206*a* is substantially flush with the second radial surface 206*b*, and the first circumferential edge 208*a* and the second circumferential edge 208*b* define a substantially consistent outer diameter of the first counterweight assembly 200. In this way, a substantially smooth transition is provided at interfaces 210 defined between the main weight 182 and the cover 202, which facilitates reducing working fluid in the chamber 122 from acting on exposed surfaces of the main weight 182 and/or cover 202 and thus preventing windage or drag on the first counterweight assembly 200.

The interfaces 210 are defined at junctions created between the circumferential end surfaces 186, 188 of the main weight 182 and circumferential end surfaces 212, 214 of the cover 202. When the first counterweight assembly 200 is assembled, a first circumferential end surface 212 of the cover 202 is adjacent the first circumferential end surface 186 of the main weight 182, to define a first interface 210, and a second circumferential end surface 214 of the cover 202 is adjacent the second circumferential end surface 188 of the main weight 182, to define a second interface 210. The cover 202 extends circumferentially between the first and second circumferential end surfaces 212, 214 a suitable arc length to cooperatively define a 360° extent with the main weight 182. As described above, the main weight 182 has an arc length between the first circumferential end surface 186 and the second circumferential end surface 188 of up to, but not exceeding, 180°. Correspondingly, the cover 202 has an arc length between the first circumferential end surface 212 and the second circumferential end surface 212 of at least 180°. In the example counterweight assembly 200, each of the cover 202 and the main weight 182 has an arc length of about 180°. In other embodiments, the main weight 182 has an arc length of less than 180° and the cover 202 correspondingly has an arc length of greater than 180°.

The cover 202 is connected to the main weight 182 using a screw connection at the interfaces 210. In particular, the first counterweight assembly 200 includes screws 216, or another suitable fastener, that are received by holes 218 in the circumferential end surfaces 186, 188 of the main weight 182 and corresponding holes (not shown) the circumferential end surfaces 212, 214 of the cover 202 to fasten the cover 202 to the main weight 182 at the interfaces 210. The circumferential edge 208*b* of the cover 202 also includes counterbores 220 defined at suitable angular locations to enable the screws 216 to extend through the circumferential end surfaces 212, 214 of the cover 202.

In the example counterweight assembly 200, the coupling ring 194 of the counterweight 168 is segmented into two semi-circular ring segments 194*a*, 194*b*. A first ring segment 194*a* is made integral with the main weight 182, and has two radial ring surfaces 222*a*, 224*a* each stepped from one of the radial surfaces 204*a*, 206*a*, respectively, of the main weight 182. The first ring segment 194*a* is circumferentially coextensive with the main weight 182, such that the radial ring surfaces 222*a*, 224*a* terminate at the circumferential end surfaces 186, 188. A second ring segment 194*b* is attached (e.g., screwed) to the first ring segment 194*a* to complete the coupling ring 194. The second ring segment 194*b* has two radial ring surfaces 222*b*, 224*b* that are respectively flush with the two radial surfaces 222*a*, 224*a* of the first ring segment 194*a* when the second ring segment 194*b* is attached to the first ring segment 194*a*. The radial ring surfaces 222*a*, 222*b* of the ring segments 194*a*, 194*b* cooperate to define a radial ring surface 222 of the coupling ring 194, and the radial ring surfaces 224*a*, 224*b* cooperate to define a radial ring surface 224 of the coupling ring 194.

The second ring segment 194*b* includes two circumferential end surfaces 226, 228 that are respectively adjacent the circumferential end surfaces 186, 188 when the ring segments 194*a*, 194*b* are attached. Screws (not shown) or another suitable fastener are received by holes 230 in the circumferential end surfaces 186, 188 and corresponding holes 232 in the second ring segment 194*b* to fasten the ring segments 194*a*, 194*b* together. The ring segment 194*b* also includes counterbores 234 defined at suitable angular locations on a circumferential edge to enable the screws or other fasteners to extend through the circumferential end surfaces 226, 228 of the ring segment 194*b*.

As shown in FIG. 6, when the first counterweight assembly 200 is assembled, and more particularly when the ring segments 194*a*, 194*b* are attached to form the coupling ring 194, a central bore 236 is defined in the coupling ring 194. The central bore 236 extends through the radial ring surfaces 222 and 224. The central bore 236 is sized and shaped to receive the driveshaft 128 and fix the first counterweight assembly 200 on the driveshaft at the desired location. One or both of the ring segments 194*a*, 194*b* may define a flat 238 in the central bore 236 that complements an alignment notch (not shown) of the driveshaft 128 for positioning, aligning, and orienting the first counterweight assembly 200 on the driveshaft 128. The alignment notch complementing the flat 238 may be defined by a keyway or groove in the driveshaft body 134 proximate the first end portion 138.

The radial surfaces 222, 224 of the coupling ring 194 are stepped relative to the radial surfaces 204, 206 of the first counterweight assembly 200. The radial surfaces 204, 206 also define a central opening 240 having a larger diameter than the central bore 236. The cover 202 is hollow and has an open circumferential face 242 (FIG. 7), or a mouth 242, opposite the circumferential edge 208*b*. The mouth 242 may at least partially receive the second ring segment 194*b* when the first counterweight assembly 200 is assembled. The mouth 242 of the cover 202 presents the hollow interior of the cover 202, which may be accessible via a gap 244 (FIG. 6) defined between the mouth 242 of the cover 202 and the coupling ring 194 when the first counterweight assembly 200 is assembled. The gap 244 may allow for fluid in the chamber 122 to leak into the hollow interior of the cover 202, which could in turn undesirably counteract the mass characteristics of the main weight 182 and thereby deteriorate the intended function of the counterweight 168. The cover 202 includes one or more drain holes 246 to allow fluid to exit the hollow interior of the cover 202 to facilitate reducing or preventing such fluid from counteracting the mass of the main weight 182. The drain holes 246 may be defined at any suitable location of the cover 202, such as one or both radial surfaces 204*b*, 206*b* and/or the circumferential edge 208*b*.

Figure 8:
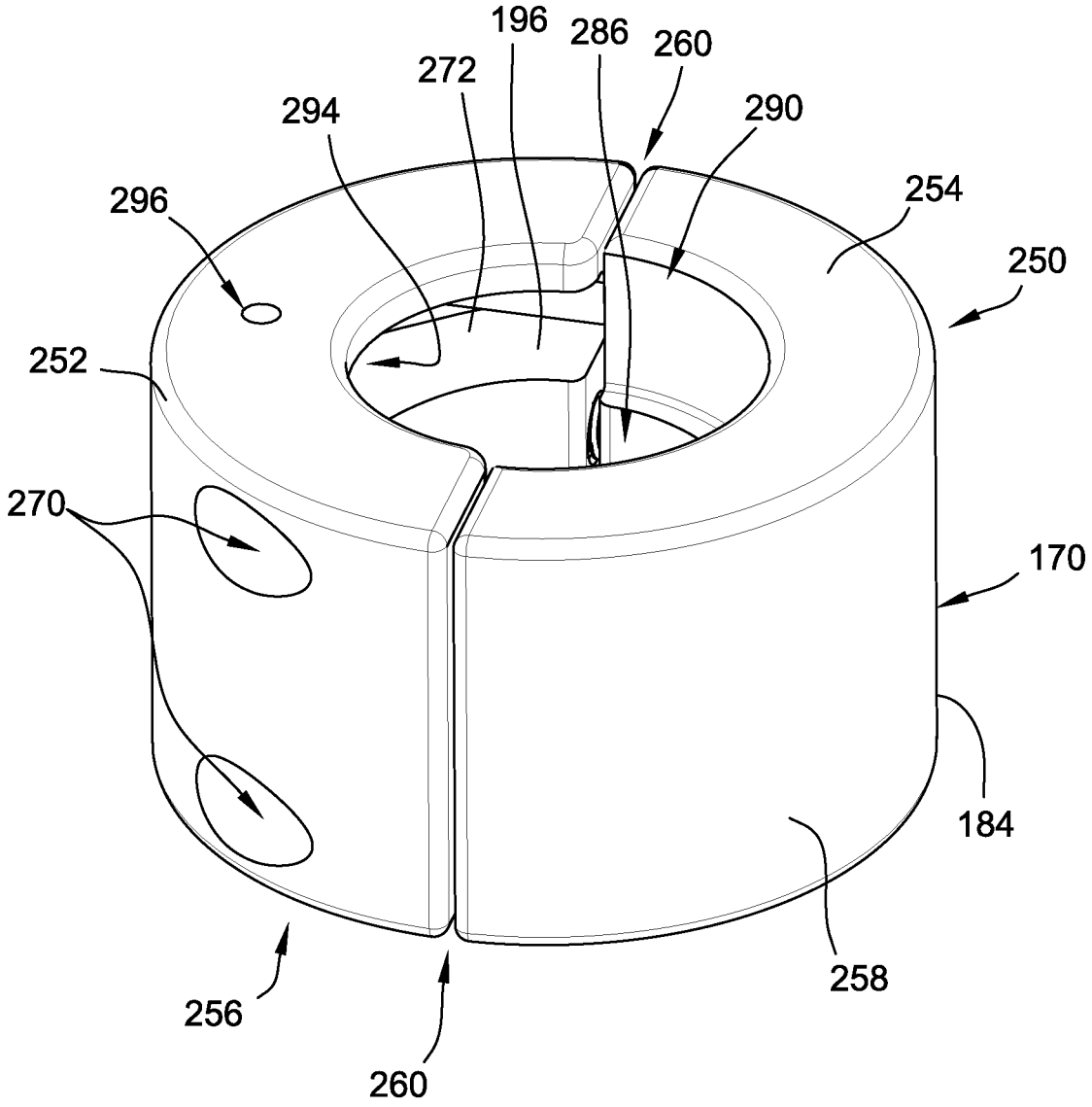
FIG. 8 is an isolated perspective of another one of the counterweight assemblies of FIG. 5.
Figure 9:
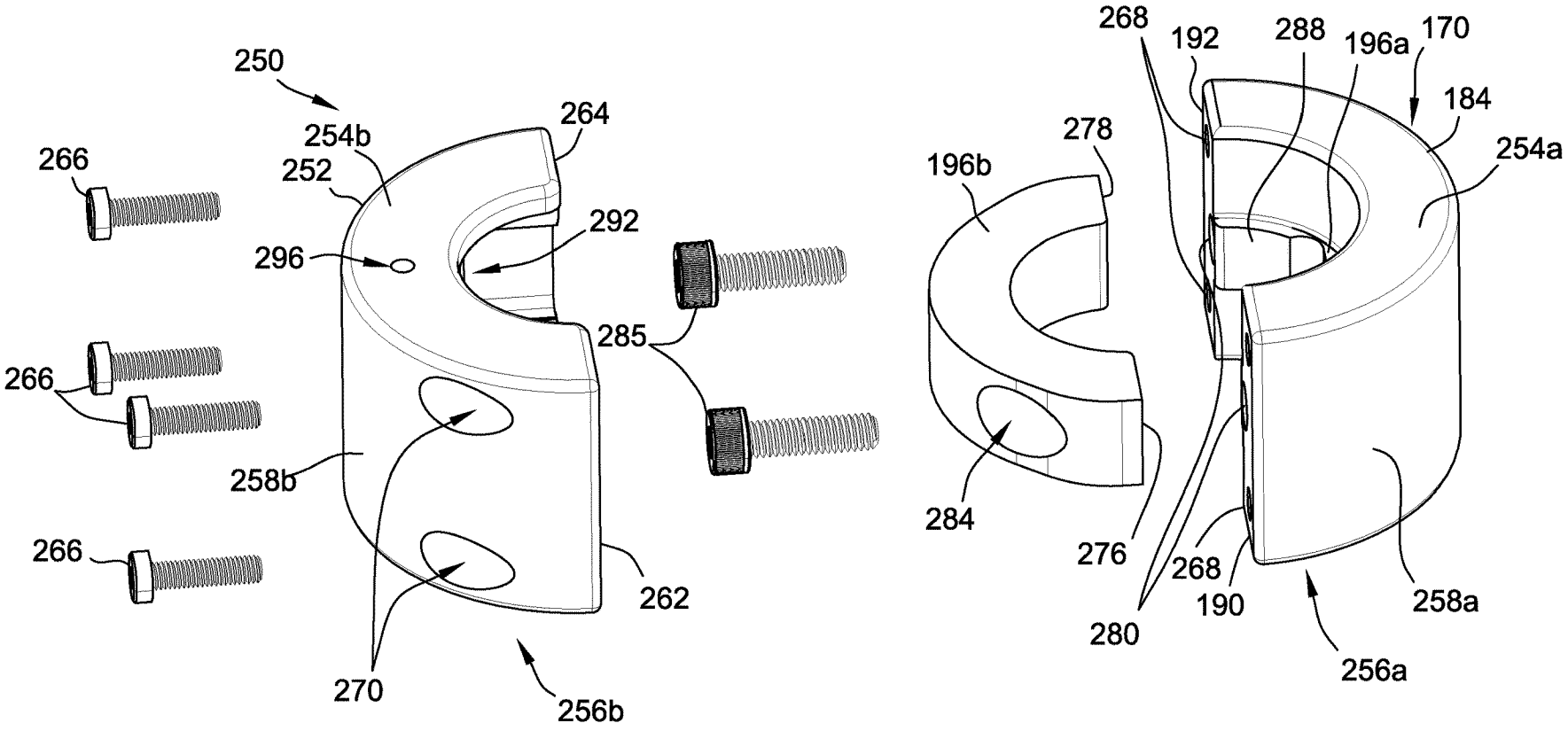
FIG. 9 is an exploded view of the counterweight assembly of FIG. 8.

Referring to FIGS. 8 and 9, the second ring-shaped counterweight assembly 250 has generally a similar construction as the first ring-shaped counterweight assembly 200, except the second counterweight assembly 250 is cylindrical in shape rather than disk-shaped. Features described for the first counterweight assembly 200 apply equally to the second counterweight assembly 250 unless explicitly stated otherwise or the context clearly indicates otherwise. In this description, various counterweight assemblies will be described, and features of these counterweight assemblies can be used in isolation or in any combination. The counterweight assemblies described herein are not limited to their respective positioning on the driveshaft 128 as shown and described for any particular embodiment. For example, a first counterweight assembly in one embodiment may be used as a second counterweight assembly in another embodiment, and vice versa. The counterweight assemblies described are also not limited to any particular dimension or geometry. For example, disk-shaped counterweight assemblies may alternatively be configured as cylindrically-shaped counterweight assemblies, and vice versa. In any given embodiment, the geometry of a counterweight assembly may be determined by a geometry of the counterweight, which in turn varies depending on the desired mass characteristics of the counterweight.

The second counterweight assembly 250 includes two radial surfaces 254, 256, which are segmented into first radial surfaces 254*a*, 256*a* and second radial surfaces 254*b*, 256*b*, and a circumferential edge 258 segmented into a first circumferential edge 258*a* and a second circumferential edge 258*b*. The first radial surfaces 254*a*, 256*a* and the first circumferential edge 258*a* are defined by the main weight 184 of the second counterweight 170 and the second radial surfaces 254*b*, 256*b* and the second circumferential edge 258*b* are defined by the cover 202. The main weight 184 and the cover 252 each has a half-cylinder shape that defines the cylindrical-shape of the second counterweight assembly 250, and the main weight 184 and the cover 252 are complementary in size such that a substantially smooth transition is provided at interfaces 260 defined between the circumferential end surfaces 190, 192 of the main weight 184 and circumferential end surfaces 262, 264 of the cover 252, as described above for the first counterweight assembly 200. The cover 252 extends circumferentially between the first and second circumferential end surfaces 262, 264 an arc length to cooperatively define a 360° extent with the main weight 184 and, in the example second counterweight assembly 250, each of the cover 252 and the main weight 184 has an arc length of about 180°. The cover 252 is connected to the main weight 184 using screws 266 or other suitable fasteners that extend through counterbores 270 in the second circumferential edge 208*b*, holes (not shown) extending from the counterbores 270 through the circumferential end surfaces 262, 264, the interfaces 260, and are received by holes 268 in the circumferential end surfaces 190, 192 of the main weight 184.

The coupling ring 196 of the counterweight 170, like the coupling ring 194 described above, is segmented into two semi-circular ring segments 196*a*, 196*b*. The two ring segments 196*a*, 196*b* are attached (e.g., screwed) using screws 285 or other suitable fasteners that extend through counterbores 284 of the ring segment 196*b*, circumferential end surfaces 276, 278 of the ring segment 196*b*, and are received by holes 280 in the circumferential end surfaces 190, 192 of the second counterweight 170. The first ring segment 196*a* is made integral with the main weight 184 and has two radial ring surfaces (not labeled) each stepped from one of the radial surfaces 254*a*, 256*a*, respectively, of the main weight 184 and terminating at the circumferential end surfaces 190, 192. The second ring segment 196*b* has two radial ring surfaces (not labeled) that are respectively flush with the two radial surfaces of the first ring segment 196*a* to define radial ring surfaces of the coupling ring 196. Only one of the radial ring surfaces (indicated at 272) is shown. A central bore 286 is defined in the coupling ring 196 and extends through the radial ring surfaces. The central bore 286 is sized and shaped to receive the driveshaft 128 and fix the second counterweight assembly 250 on the driveshaft at the desired location, and one or both ring segments 196*a*, 196*b* may define a flat 288 in the central bore 286 that complements an alignment notch (not shown) of the driveshaft 128 for positioning, aligning, and orienting the second counterweight assembly 250 on the driveshaft 128. The alignment notch complementing the flat 288 may be defined by a keyway or groove in the driveshaft body 134 proximate the second end portion 140.

As described above for the coupling ring 194, the radial surfaces of the coupling ring 196 may be stepped relative to the radial surfaces 254, 256 of the second counterweight assembly 250 which define a central opening 290. The central opening 290 may have a larger diameter than the central bore 286. The cover 252, like the cover 202, is hollow and has an open face 292 (FIG. 9) or mouth 292 opposite the circumferential edge 208*b*. The mouth 292 may at least partially receive the second ring segment 196*b* when the second counterweight assembly 250 is assembled. The mouth 292 of the cover 252 presents the hollow interior of the cover 252, which may be accessible via a gap 294 (FIG. 6) defined between the mouth 292 of the cover 252 and the coupling ring 196, and the cover 252 includes one or more drain holes 296 to allow fluid to exit the hollow interior of the cover 252. The drain holes 296 may be defined at any suitable location of the cover 252, such as one or both radial surfaces 254*b*, 256*b* and/or the circumferential edge 258*b*.

The ring-shaped counterweight assemblies 200, 250 may facilitate reducing drag and windage that would otherwise be created by exposed surfaces (e.g., the circumferential end surfaces 186, 188 and 190, 192) of the counterweights 168, 170, however, the counterweight assemblies 200, 250 may still create the propensity for such drag and windage. For example, counterbores (e.g., the counterbores 220, 270) formed in the covers 202, 252 may provide surfaces that work against fluid in the chamber 122 to create drag or windages on the counterweight assemblies 200, 250. Additionally, it may be tedious to assemble and/or install the counterweight assemblies 200, 250, and which include numerous components attached together using screws or other fasteners. The screwed connections between the cover 202, 252 and the counterweights 168, 170, and between the coupling rings 194, 196 and the main weights 182, 184, also require some material loss from the counterweights 168, 170 due to the holes drilled in the circumferential end surfaces 186, 188 and 190, 192 for receiving screws or other fasteners, which may affect otherwise finely tuned mass characteristics of the counterweights. Moreover, the machining required to enable the screwed connections creates the opportunity for misalignment between the ring segments 194*a*, 194*b* and 196*a*, 196*b*, which may result in misalignment of the counterweights 168, 170 on the driveshaft 128 and negatively impact the function of the counterweights 168, 170, as well as misalignment between the covers 202, 252 and the main weights 182, 184, which may result in exposed counterweight surfaces that are susceptible to drag or windage from fluid in the chamber 122.

Referring now to FIGS. 10-35, various embodiments of ring-shaped counterweight assemblies positioned on the driveshaft 128 will now be described that each include a cover and a counterweight that cooperate to form the ring shape. Unlike the counterweight assemblies 200, 250, the counterweight assemblies described below include the cover that is attached to one of the driveshaft and the counterweight using a snap fit connection that eliminates the need for screws or other mechanical fasteners for attaching the cover and the counterweight and for attaching the counterweight assembly to the driveshaft 128. As such, the embodiments described below may overcome the above-described disadvantages that may be associated with the counterweight assemblies 200, 250, including, for example, by facilitating quick and efficient assembly and disassembly of the counterweight assembly, quick and efficient installation and de-installation of the counterweight assembly on the driveshaft 128, reducing the opportunity for alignment error, reducing the number of components include in the counterweight assembly, and/or reducing the propensity for windage and drag on the counterweight assembly from fluid in the chamber 122. The snap fit connections may also reduce the amount of material needed to form the counterweight/counterweight assembly, because additional mass is not needed to compensate for the screwed connections used to assemble the counterweight assembly. The covers are also suitably made of a relatively lower density material, such as a plastic, which facilitates minimizing the amount of mass of the cover that counteracts the mass characteristics of the counterweight. Additional and/or alternative advantages of the various embodiments are described in greater detail below and/or will be appreciated upon reading the following description.

Figure 10:
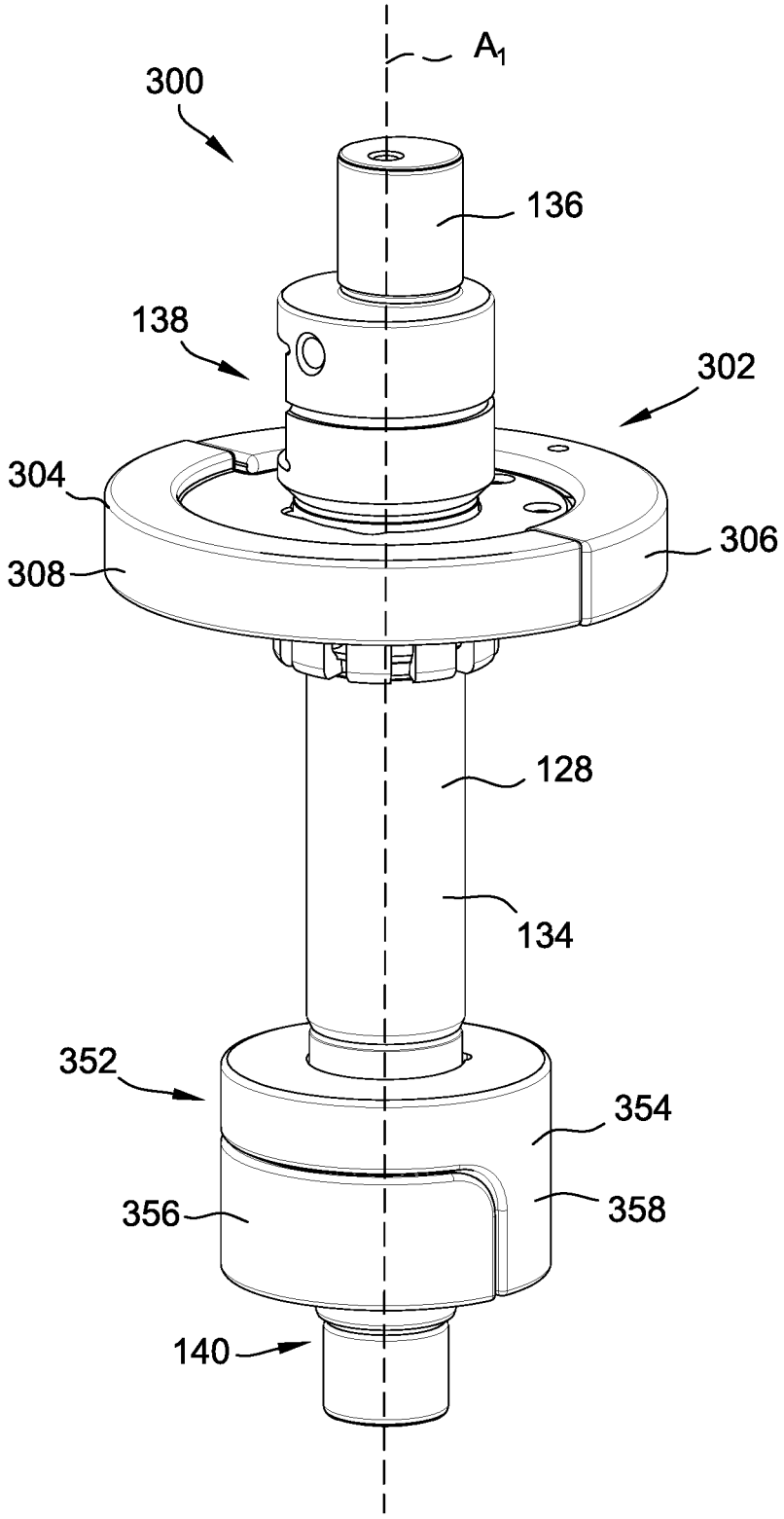
FIG. 10 is an isolated perspective of another example subassembly that includes the driveshaft and two counterweight assemblies.

FIG. 10 depicts an example subassembly 300 that may be used in the compressor 100 (FIGS. 1-3) in lieu of the subassembly 180 (FIG. 4). The subassembly 300 includes the driveshaft 128 of the compressor 100 and two ring-shaped counterweight assemblies 302, 352 positioned on the driveshaft 128 at suitable locations, such as the locations described above for the counterweight assemblies 200, 250. A first counterweight assembly 302 includes a counterweight 304 and a cover 306 that cooperate to form a disk-shape of the counterweight assembly 302. A second counterweight assembly 352 includes a counterweight 354 and a cover 356 that cooperate to form a cylindrical-shape of the counterweight assembly 352. The counterweights 304, 354 each include a semi-circular main weight 308, 358 that are sized and shaped to achieve desired mass characteristics and, as described above, may vary in size and shape depending on the intended application of the compressor 100 as well as the degree of balancing and load reduction required or desired from the counterweights 304, 354. The counterweights 304, 354, and the counterweight assemblies 302, 352, may have any suitable shape to enable the counterweight assemblies 302, 352 to function as described and as desired. Unless expressly stated otherwise or the context clearly indicates otherwise, description of the counterweights 168, 170, and the main weights 182, 184, applies to the counterweights 304, 354, and the main weights 308, 358.

Referring to FIGS. 11-14, the first counterweight assembly 302 includes two radial surfaces 310, 312, which are segmented into first radial surfaces 310*a*, 312*a* and second radial surfaces 310*b*, 312*b*, and a circumferential edge 314 segmented into a first circumferential edge 314*a* and a second circumferential edge 314*b*. The first radial surfaces 310*a*, 312*a* and the first circumferential edge 314*a* are defined by the main weight 308 and the second radial surfaces 310*b*, 312*b* and the second circumferential edge 314*b* are defined by the cover 306. The main weight 308 and the cover 306 each has a half-disk shape that defines the disk-shape of the first counterweight assembly 302, and the main weight 308 and the cover 306 are complementary in size such that a substantially smooth transition is provided at interfaces 316 defined between adjacent circumferential ends of the main weight 308 and the cover 306. The cover 306 and the main weight 308 each extend circumferentially between the interfaces 316 an arc length to cooperatively define a 360° circumferential extent. In the example first counterweight assembly 302, each of the cover 306 and the main weight 308 has an arc length of about 180°.

Figure 11:
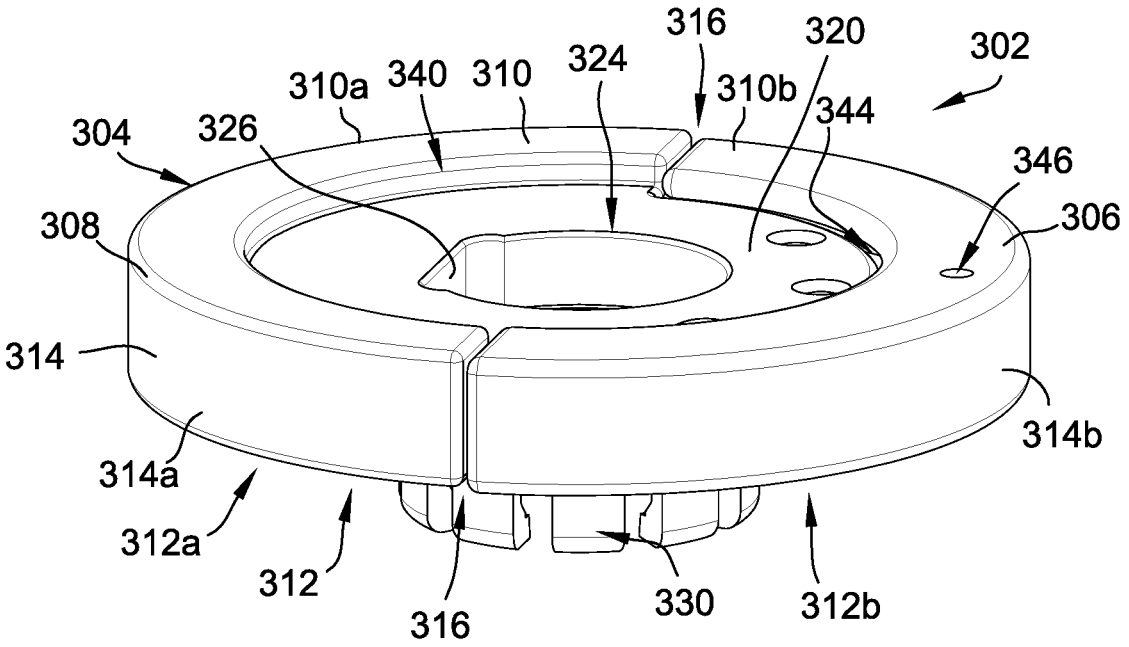
FIG. 11 is an isolated perspective of one of the counterweight assemblies of FIG. 10.
Figure 12:
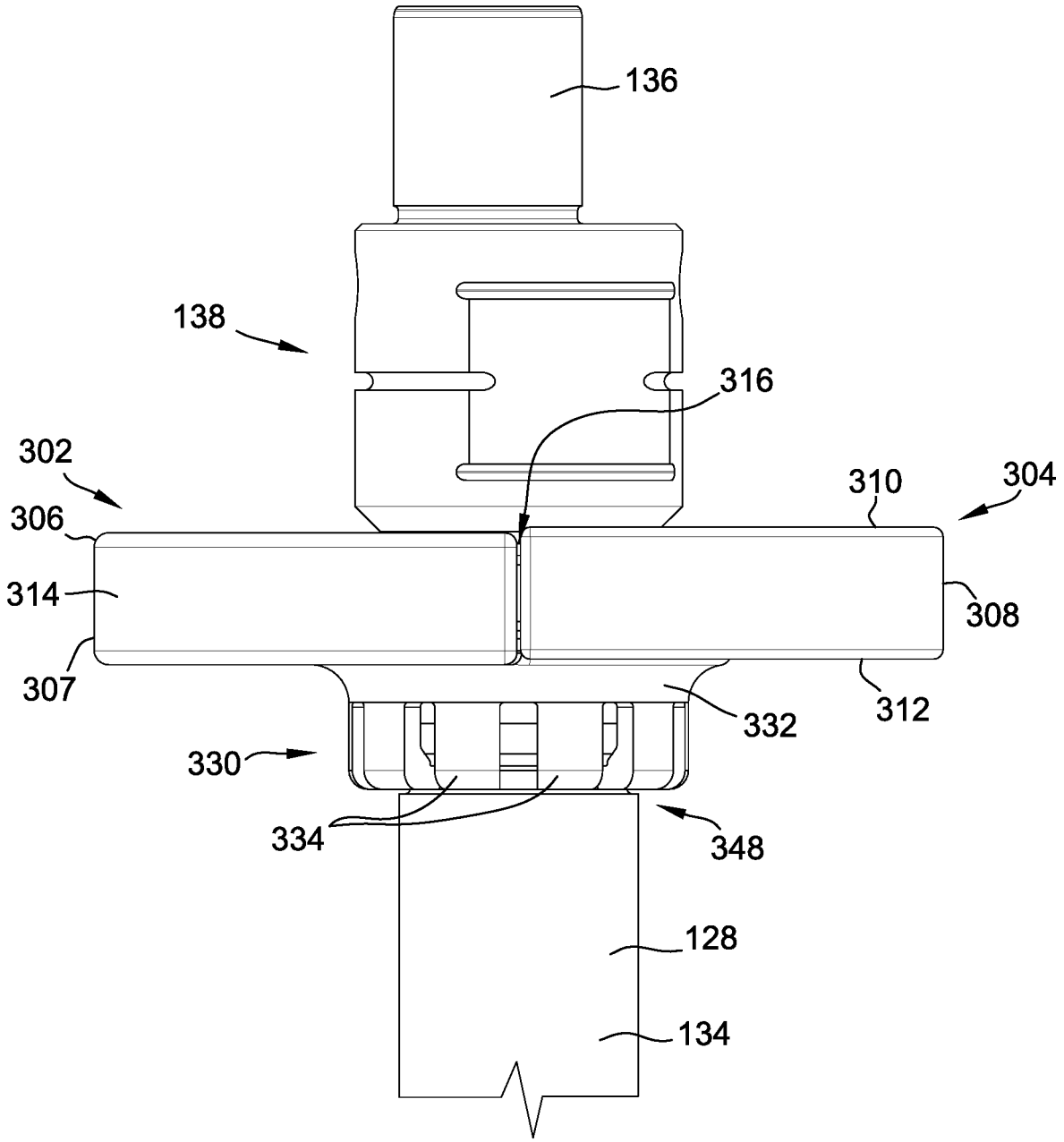
FIG. 12 is a side view of the counterweight assembly of FIG. 11 shown positioned on the driveshaft.
Figure 13:
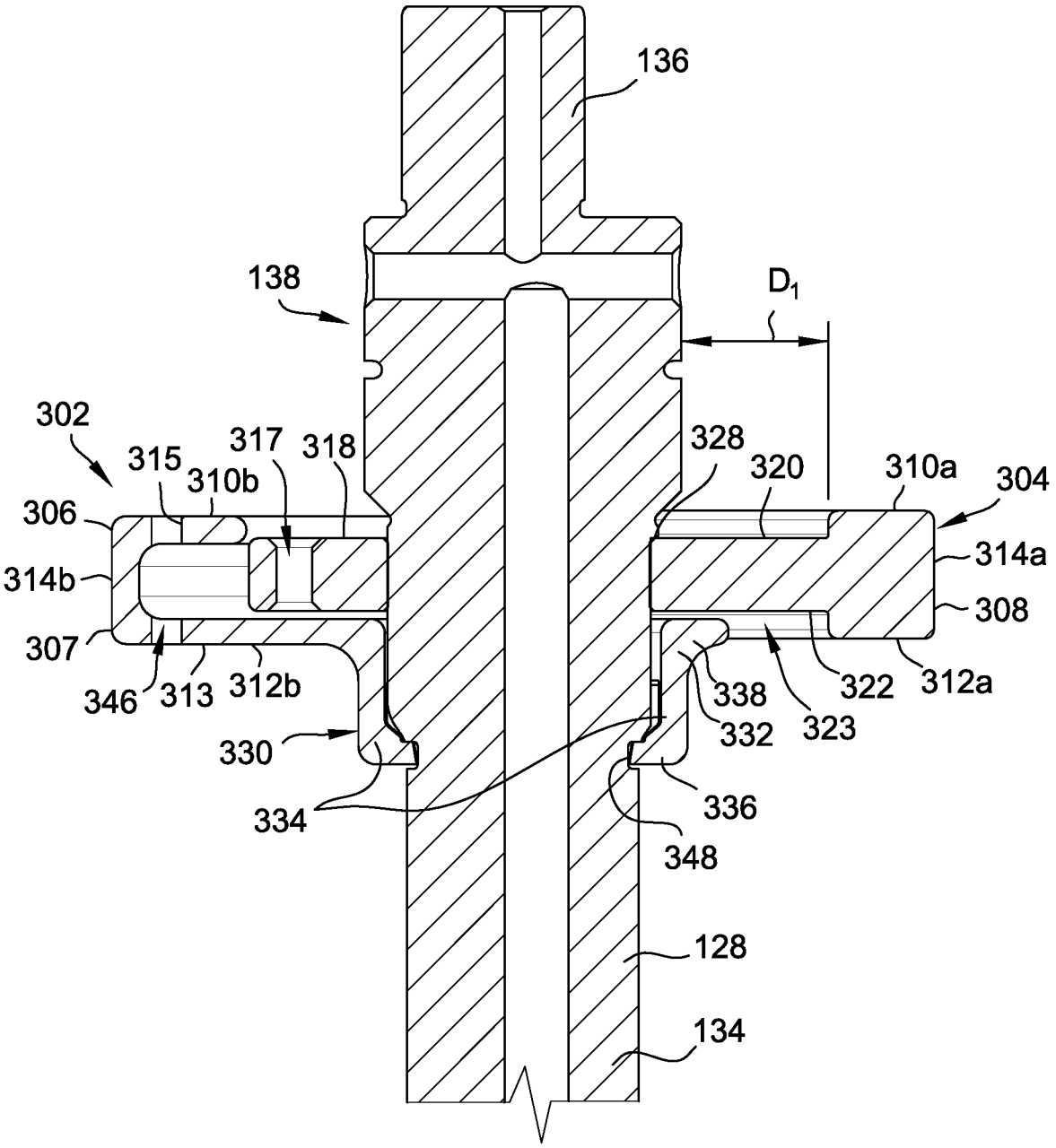
FIG. 13 is a section of the side view shown in FIG. 12.
Figure 14:
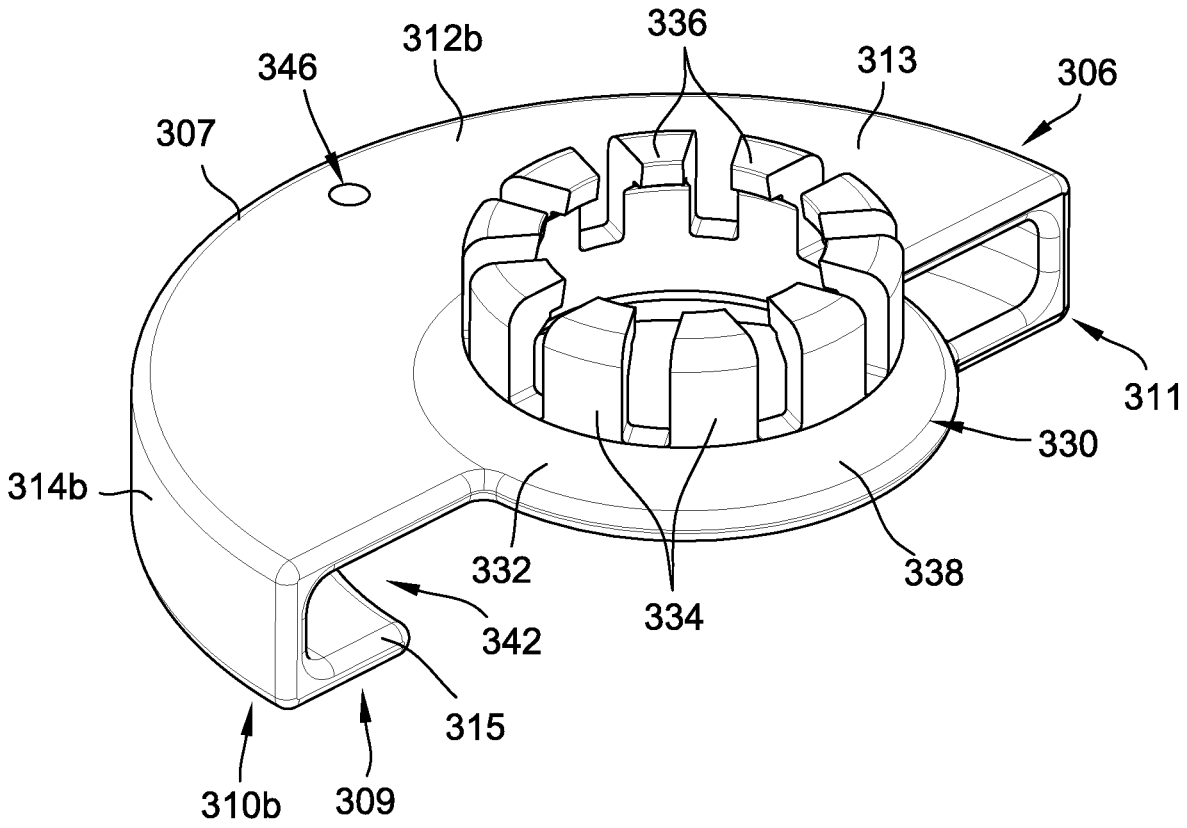
FIG. 14 is a bottom perspective of a cover of the counterweight assembly of FIG. 11.

The first counterweight 304 is positioned on the driveshaft 128 using a coupling ring 318 that is made integral with the main weight 308 as a one-piece unit. The main weight 308 and the cover 306 cooperate to bound the coupling ring 318. Unlike the coupling rings 194, 196 described above, the coupling ring 318 does not require screwed connections for assembly. The coupling ring 318 includes two radial surfaces 320, 322. A central bore 324 is defined in the coupling ring 318 and extends through the radial ring surfaces 320, 322. The central bore 324 is sized and shaped (as shown in FIGS. 11 and 13) to receive the driveshaft 128 and fix the first counterweight 304 on the driveshaft at the desired location. In this example, the central bore 324 is substantially circular to complement a circular cross-section of the driveshaft 128, and an inner diameter of the central bore 324 is approximately equal to an outer diameter of the driveshaft at the location at which the first counterweight 304 is fixed. The central bore 324 may have any suitable size and shape to enable the coupling ring 318 to function as described. The coupling ring 318 may also define a flat 326 in the central bore 324 that complements an alignment notch 328 (FIG. 13) of the driveshaft 128, such as a keyway or groove, for positioning, aligning, and orienting the first counterweight 304 on the driveshaft 128.

The radial surfaces 320, 322 of the coupling ring 318 are stepped relative to the radial surfaces 310, 312, respectively. The radial surfaces 310, 312 also define a central opening 340 having a larger diameter than the central bore 324. The cover 306, like the covers 202, 252 described above, is hollow and has a mouth 342 that presents the hollow interior of the cover 306. The cover 306 also includes one or more drain holes 346 that, similar to the drain holes 246, 296 described above, facilitate draining fluid from the hollow interior, which fluid enters via a gap 344 defined between the mouth 342 of the cover 306 and the coupling ring 318. The drain holes 346 may be defined at any suitable location of the cover 306, such as one or both radial surfaces 310*b*, 312*b* and/or the circumferential edge 314*b*.

A radial extent of the coupling ring 318 between the main weight 308 and the driveshaft 128 is such that the main weight 308 is positioned a radial distance $D_1$ (FIG. 13) from the driveshaft 128. The radial surfaces 320, 322 of the coupling ring 318 that are stepped relative to the radial surfaces 310*a*, 312*a* provide a lower mass of the coupling ring 318 relative to a weight of the main weight 308. The relatively higher mass of the main weight 308, which primarily defines the mass characteristics of the counterweight 304, moves a center of mass of the counterweight 304 radially outward from the driveshaft 128. The size and shape of the main weight 308 are selected to control the mass characteristics of the counterweight 304, and the radial distance $D_1$ is selected to control the spatial relation between the center of mass of the counterweight 304 and the driveshaft 128. In some examples, it may be desirable to position the center of mass of the counterweight 304 a relatively longer radial distance from the driveshaft 128, and a relatively longer radial distance $D_1$ may be selected accordingly.

In the first counterweight assembly 302, the cover 306 is attached to the driveshaft 128 separate from the counterweight 304. The cover 306 includes a coupling collar 330 that facilitates connecting the cover 306 to the driveshaft 128 via a snap fit connection. The coupling collar 330 is cylindrical in shape and extends downward from a main body 307 of the cover 306. The main cover body 307 defines the half-disk-shape of the cover 306 and defines the second radial surfaces 310*b*, 312*b* and the second circumferential edge 314*b*. The coupling collar 330 has a greater circumferential extent than the main cover body 307 and surrounds the driveshaft 128 when attached thereto. The coupling collar 330 includes a circular base 332 extending downward from the main cover body 307 and flexible fingers 334 that extend downward from the base 332. The flexible fingers 334 include inward-extending grips 336 opposite the base 332. The grips 336 engage a circumferential groove 348 in the driveshaft 128 to form the snap fit connection that attaches the cover 306 to the driveshaft 128. The flexible fingers 334 articulate proximate the base 332 to enable the cover 306 to slide along the driveshaft 128 until the grips 336 are received by the circumferential groove 348. The circumferential groove 348 may be a continuous groove or may be formed as a series of discrete grooves that each receive one of the grips 336.

As shown in FIG. 13, when the counterweight assembly 302 is assembled, the base 332 is positioned adjacent the radial surface 322 of the coupling ring 318. The main cover body 307 has a bottom platform 313, or bottom 313, that extends radially outward from the base 332 to the circumferential edge 314*b*. The bottom 313 of the main cover body 307 defines the radial surface 312*b* and covers the radial surface 322 of the coupling ring 318. Alternatively stated, the radial surface 322 of the coupling ring 318 is covered by the bottom 313 of the main cover body 307 over the portion of the coupling ring 318 that is bound by the main cover body 307. The radial surface 322 over the other portion of the coupling ring 318 that is bound by the main weight 308 is stepped from the radial surface 312*a* of the main weight 308 and defines a recess 323. The base 332 of the coupling collar 330 includes a semi-circular lip 338 that extends radially outward and at least partially fills the recess 323, as shown in FIG. 13. The lip 338 facilitates reducing or eliminating drag and windage from fluid in the chamber 122 of the compressor 100. In particular, the lip 338 operates to at least partially fill the recess 323 to reduce exposed surface area of circumferential ends 309, 311 of the main cover body 307 in the recess 323, for example, exposed surface area of the bottom 313 of the main cover body 307 that covers the radial surface 322 of the coupling ring 318.

The main cover body 307 also includes a top platform 315, or top 315, spaced from the bottom 313 and joined to the bottom 313 by the circumferential edge 314*b*. The top 315 and the bottom 313 of the main cover body 307 define the mouth 342 of the cover 306. The top 315 extends radially inward from the circumferential edge 314*b* and terminates radially outboard of the coupling collar 330. The top 315 terminates at a suitable radial location such that a clearance 317 is defined by the top 315. Referring to FIG. 13, the clearance 317 allows the cover 306 to be installed on the driveshaft 128 after the counterweight 304 without the coupling ring 318 interfering with the top 315. The clearance 317 is suitably sized to allow such installation while minimizing the size of the gap 344 (FIG. 11) that is defined between the mouth 342 and the coupling ring 318.

Figure 15:
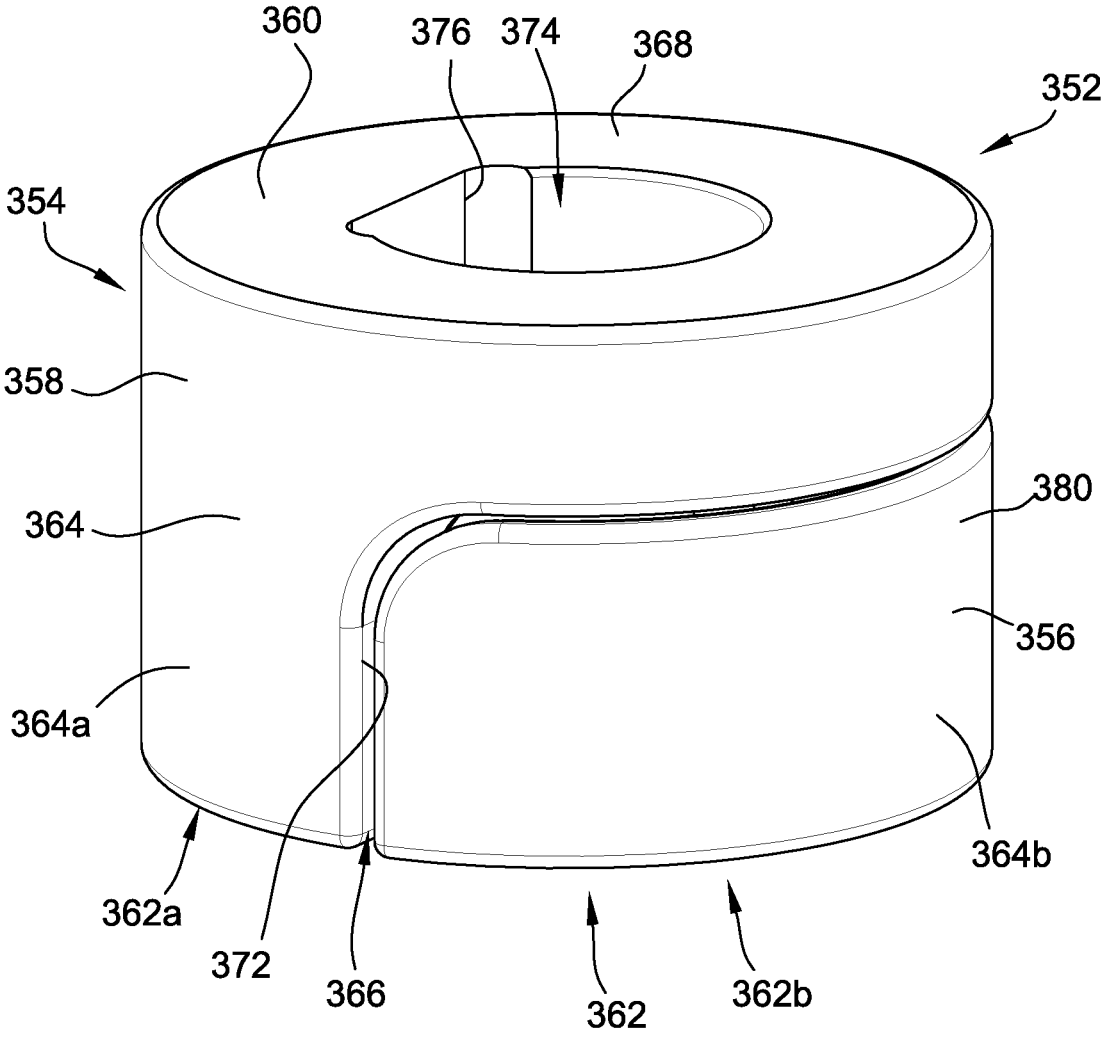
FIG. 15 is an isolated perspective of another one of the counterweight assemblies of FIG. 10.
Figure 16:
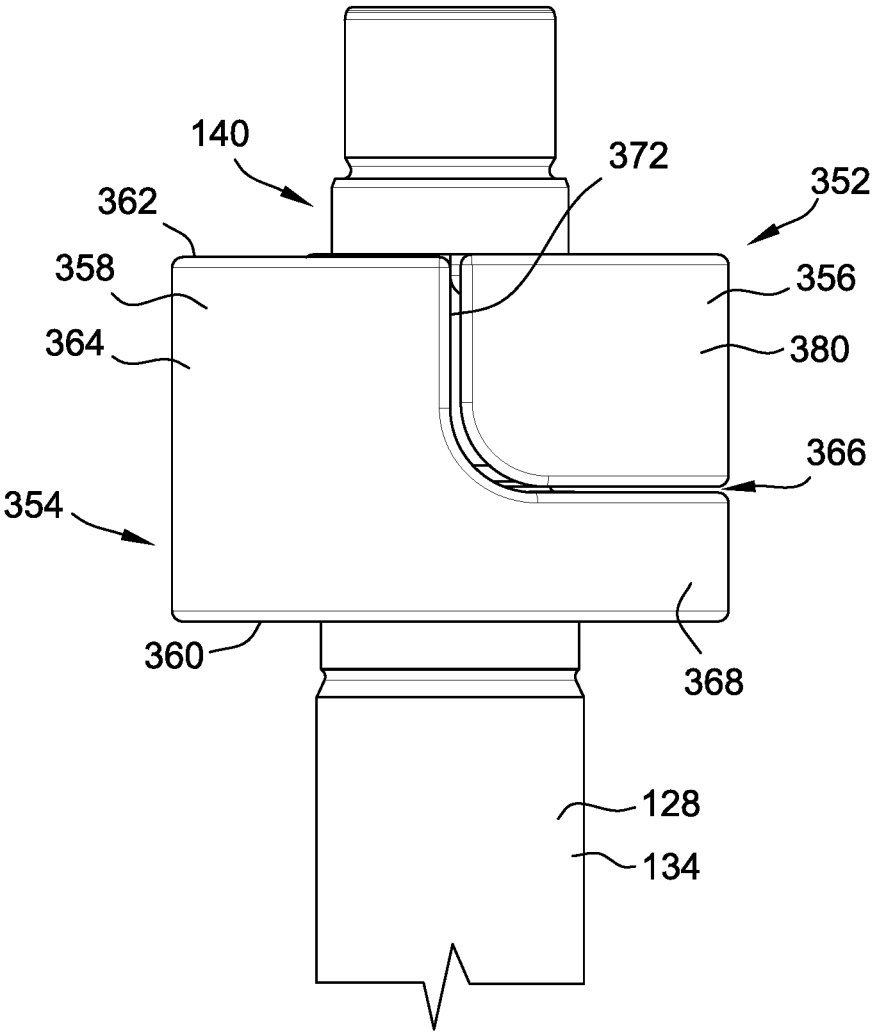
FIG. 16 is a side view of the counterweight assembly of FIG. 15 shown positioned on the driveshaft.
Figure 17:
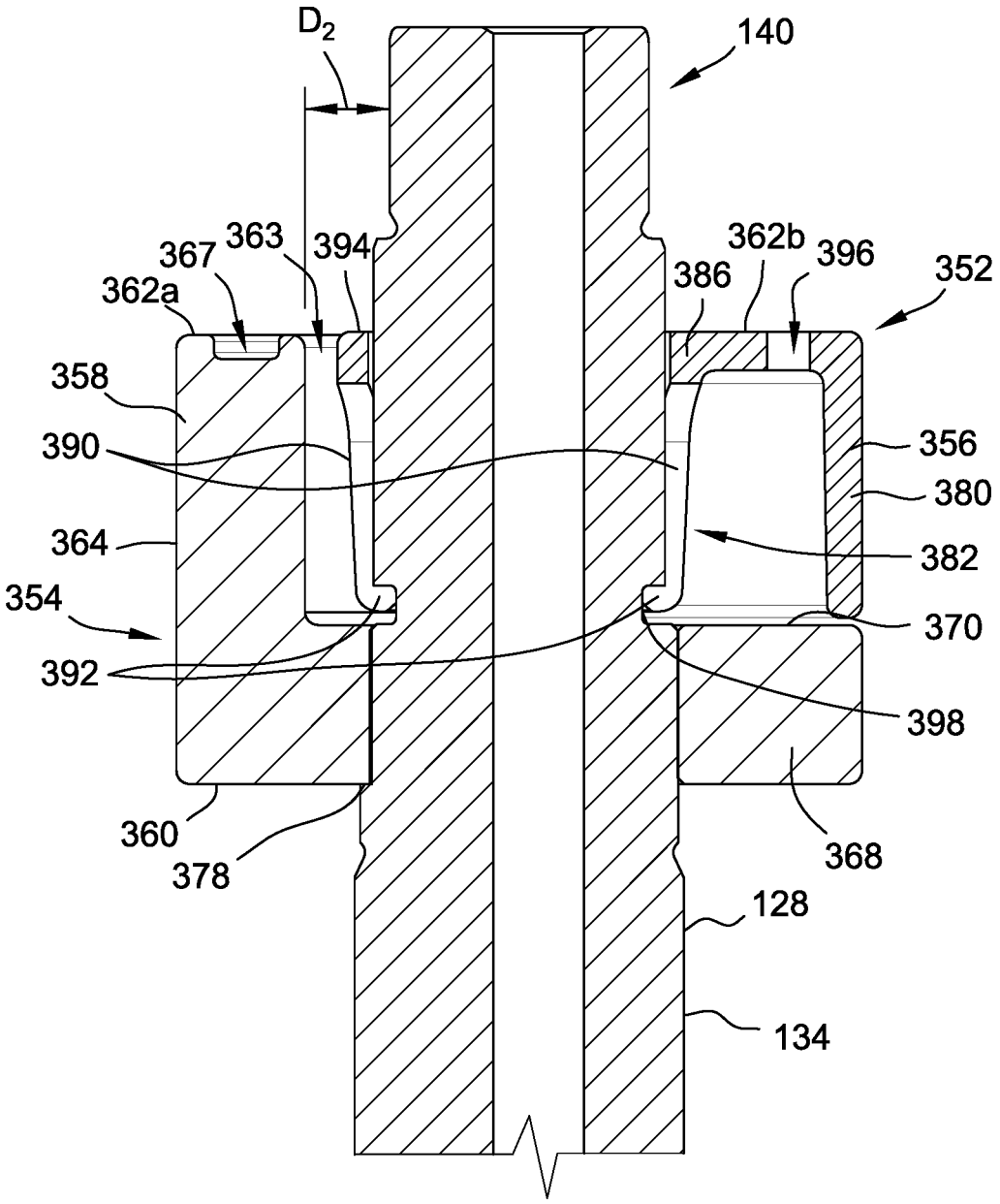
FIG. 17 is a section of the side view shown in FIG. 16.
Figure 18:
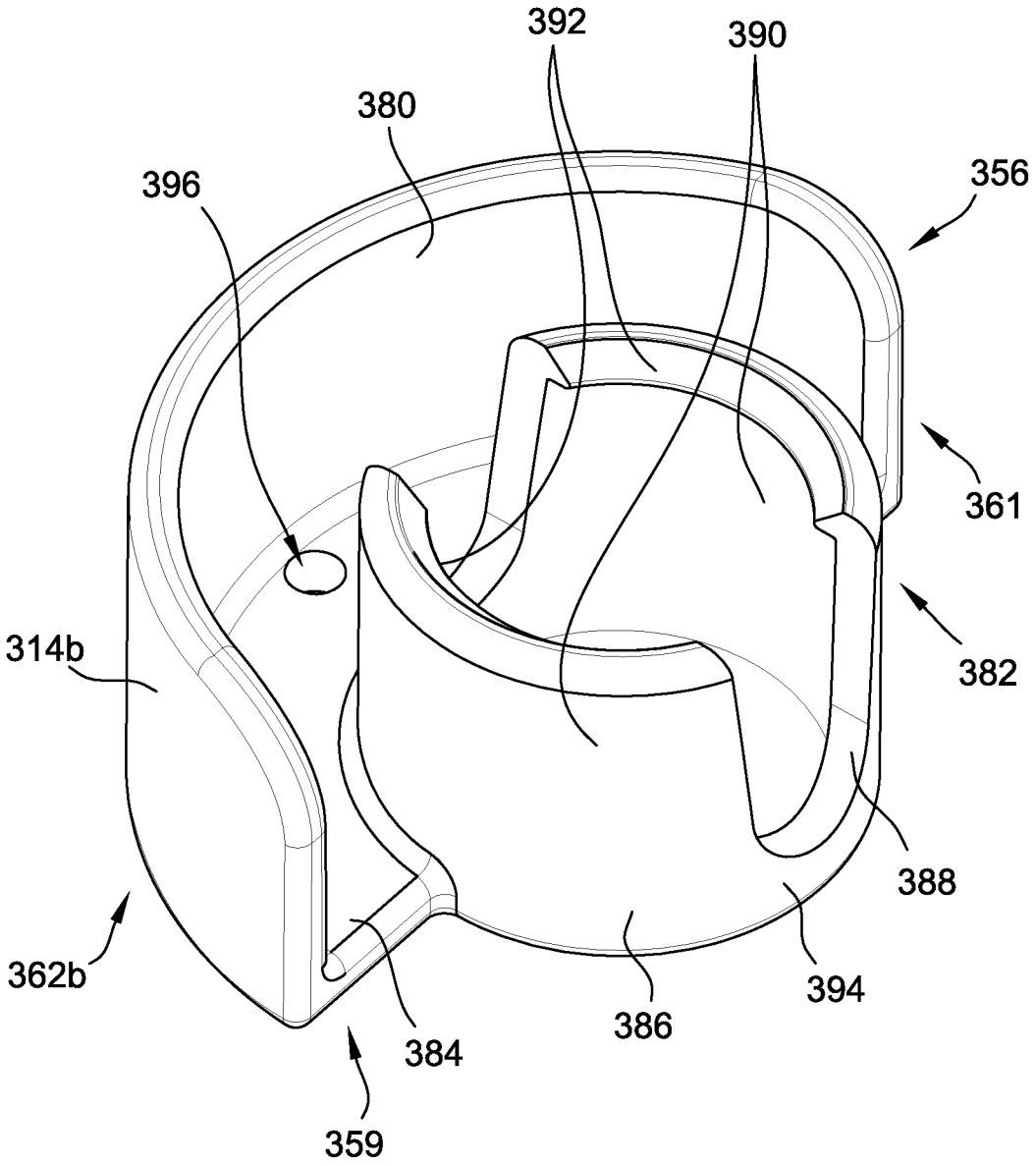
FIG. 18 is a bottom perspective of a cover of the counterweight assembly of FIG. 15.

Referring to FIGS. 15-18, the second counterweight assembly 352 includes the second counterweight 354 that has a coupling ring 368 and a main weight 358 made integral with the coupling ring 368 as a one-piece unit. The main weight 358 is a semi-cylindrical extension of the coupling ring 368 and defines an arcuate recess 372 in a circumferential edge 364*a* of the counterweight 354. The coupling ring 368 and the main weight 358 cooperate to define the circumferential edge 364*a* of the counterweight 354, which has a substantially consistent outer diameter with the exception of the recess 372. The coupling ring 368 defines a radial surface 360 of the second counterweight assembly 352 and a radial surface 370 opposite the radial surface 360. The coupling ring 368 also defines a central bore 374 through the radial surfaces 360, 370. The central bore 374 extends through the counterweight 354 and is sized and shaped (as shown in FIGS. 15 and 17) to receive the driveshaft 128 and fix the second counterweight 354 on the driveshaft at the desired location. In this example, the central bore 374 is substantially circular to complement a circular cross-section of the driveshaft 128, and an inner diameter of the central bore 374 is approximately equal to an outer diameter of the driveshaft at the location at which the second counterweight 354 is fixed. The central bore 374 may have any suitable size and shape to enable the coupling ring 368 to function as described. The coupling ring 368 may also define a flat 376 in the central bore 374 that complements an alignment notch 378 (FIG. 17) of the driveshaft 128, such as a keyway or groove, for positioning, aligning, and orienting the second counterweight 354 on the driveshaft 128.

As shown in FIG. 17, the semi-cylindrical main weight 358 extends from an outer peripheral portion of the radial surface 370. A semi-circular portion of the radial surface 370 extends radially between the main weight and the central bore 374. When the second counterweight 354 is installed on the driveshaft 128, the main weight 358 is positioned a radial distance $D_2$ from the driveshaft 128. As described above for the counterweight 304, the size and shape of the main weight 358 are selected to control the mass characteristics of the counterweight 354, which are primarily defined by the main weight 358, and the radial distance $D_2$ is selected to control the spatial relation between the center of mass of the counterweight 354 and the driveshaft 128. In this way, the mass balancing characteristics of the counterweights 304 and 354 may be finely tuned.

The cover 356 cooperates with the second counterweight 354 to define a cylindrical-shape of the second counterweight assembly 352 having the radial surface 360 and a second radial surface 362 opposite the radial surface 360, and a circumferential edge 364 between the radial surfaces 360, 362. The radial surface 362 is cooperatively defined by a first radial surface 362*a* of the main weight 358 and a second radial surface 362*b* of the cover 356. The circumferential edge 364 is cooperatively defined by the circumferential edge 364*a* of the second counterweight 354 and a circumferential edge 364*b* of the cover 356.

The cover 356 includes a semi-circular shield 380, a coupling collar 382, and a platform 384 extending between the shield 380 and the coupling collar 382. The shield 380 defines the circumferential edge 364*b* of the cover 356 and is shaped to complement a shape of the recess 372 defined in the circumferential edge 364*a* of the counterweight 354. When the second counterweight assembly 352 is assembled, the shield 380 is seated in the recess 372 and completes the circumferential edge 364 of the counterweight assembly 352.

As shown in FIGS. 15 and 16, a U-shaped interface 366 is defined between the shield 380 and the counterweight 354. The shape of the interface 366 is determined by the shape of the recess 372 and corresponding shape of the shield 380. Fluid from the chamber 122 may enter between the shield 380 and the counterweight 354 through a gap at the interface 366. The cover 356 includes one or more drain holes 396 at suitable locations (e.g., in the platform 384) to allow such fluid to exit. The main weight 358 and the shield 380 each has a semi-circular shape, and the shield 380 and counterweight 354 are complementary in size such that a substantially smooth transition is provided at the interface 366. The shield 380 extends circumferentially along the interface 366 an arc length to cooperatively define a 360° circumferential extent with the main weight 358. In the example first counterweight assembly 352, each of the shield 380 and the main weight 358 has an arc length of about 180°.

The shield 380 extends upward from the platform 384, and the shield 380 and platform 384 define circumferential ends 359, 361 of the cover 356. The coupling collar 382 also extends upward from the platform 384, radially inward from the shield 380. Similar to the coupling collar 330 of the cover 306, the coupling collar 382 facilitates attaching the cover 356 to the driveshaft 128 separate from the counterweight 354. In particular, the coupling collar 382 that facilitates attaching the cover 356 to the driveshaft 128 via a snap fit connection. The coupling collar 382 is cylindrical in shape and has a greater circumferential extent than the platform 384 and surrounds the driveshaft 128 when attached thereto. The coupling collar 382 includes a circular base 386 extending upward from the platform 384 and outward from the circumferential ends 359, 361. Two arch-shaped cut-outs 388 are formed in the coupling collar 382 and define two flexible fingers 390 that extend upward from the base 386. The flexible fingers 390 include inward-extending grips 392 opposite the base 386. The grips 392 engage a circumferential groove 398 in the driveshaft 128 to form the snap fit connection that attaches the cover 356 to the driveshaft 128. The arch-shaped cut outs 388 expand in size between the base 386 and the grips 392 to allow the flexible fingers 390 to articulate, thereby enabling the cover 356 to slide along the driveshaft 128 until the grips 392 are received by the circumferential groove 398. The circumferential groove 398 may be a continuous groove or may be formed as two discrete grooves that each receive one of the grips 392.

When the counterweight assembly 352 is assembled, the base 386 is positioned adjacent the radial surface 362*a* defined by the main weight 358. As shown in FIG. 13, due to the distance $D_2$ between the main weight 308 and the driveshaft 128, a gap 363 may exist between the base 386 and the radial surface 362*a*. The gap 363 may allow fluid from the chamber 122 to enter into a hollow interior of the second counterweight assembly 352, which could affect the finely-tuned mass characteristics of the main weight 358 and negatively impact the function of the counterweight 354 as described above. The cover 356 has the one or more drain holes 396 to allow such fluid to exit the hollow interior of the counterweight assembly 352. The base 386 also includes a bulge 394 that extends radially outward relative to the coupling collar 382. The bulge 394 limits the size of the gap 363 between the base 386 and the radial surface 362*a*, which in turn facilitates limiting or restricting fluid from the chamber 122 from entering the hollow interior of the second counterweight assembly 352.

Advantages of the subassembly 300 described above with reference to FIGS. 10-18 include, but are not limited to only including, a) eliminating the need for any screws or other fasteners to assemble and install the counterweight assemblies 302, 352 by using a press-fit between the driveshaft 128 and the coupling rings 318, 368 made integral with the main weight 308, 358 to fix the counterweights 304, 354 on the driveshaft 128 and by using a separate snap fit connection between coupling collars 330, 382 of the covers 306, 356 and the driveshaft 128; b) including features such as the clearance 317 defined by the top 315 of the main cover body 307 to provide flexibility in the installation of the counterweight assemblies 200, 250; c) including filler features of the coupling collars 330, 382, such as the lip 338 and the bulge 394, that operate in conjunction with the flexible fingers 334, 390 to fill gaps between the covers 306, 356 and the counterweights 304, 354, thereby reducing the opportunity for working fluid from negatively impacting the function of the counterweights; d) including drain holes 346, 396 in the covers 306, 356 to provide an exit for fluid that may accumulate between the covers 306, 356 and the counterweights 304, 354; c) using articulating fingers 334, 390 and corresponding grooves 348, 398 in the driveshaft 128 for quick installation and de-installation of the covers 306, 356 and enable the covers to be retrofitted with existing counterweight designs; and/or f) forming an interface 316, 366 between the cover 306, 356 and the counterweight 304, 354 that provides a smooth transition, reduces opportunity for windage and drag, and also facilitates anti-rotation of the cover relative to the counterweight.

Figure 19:
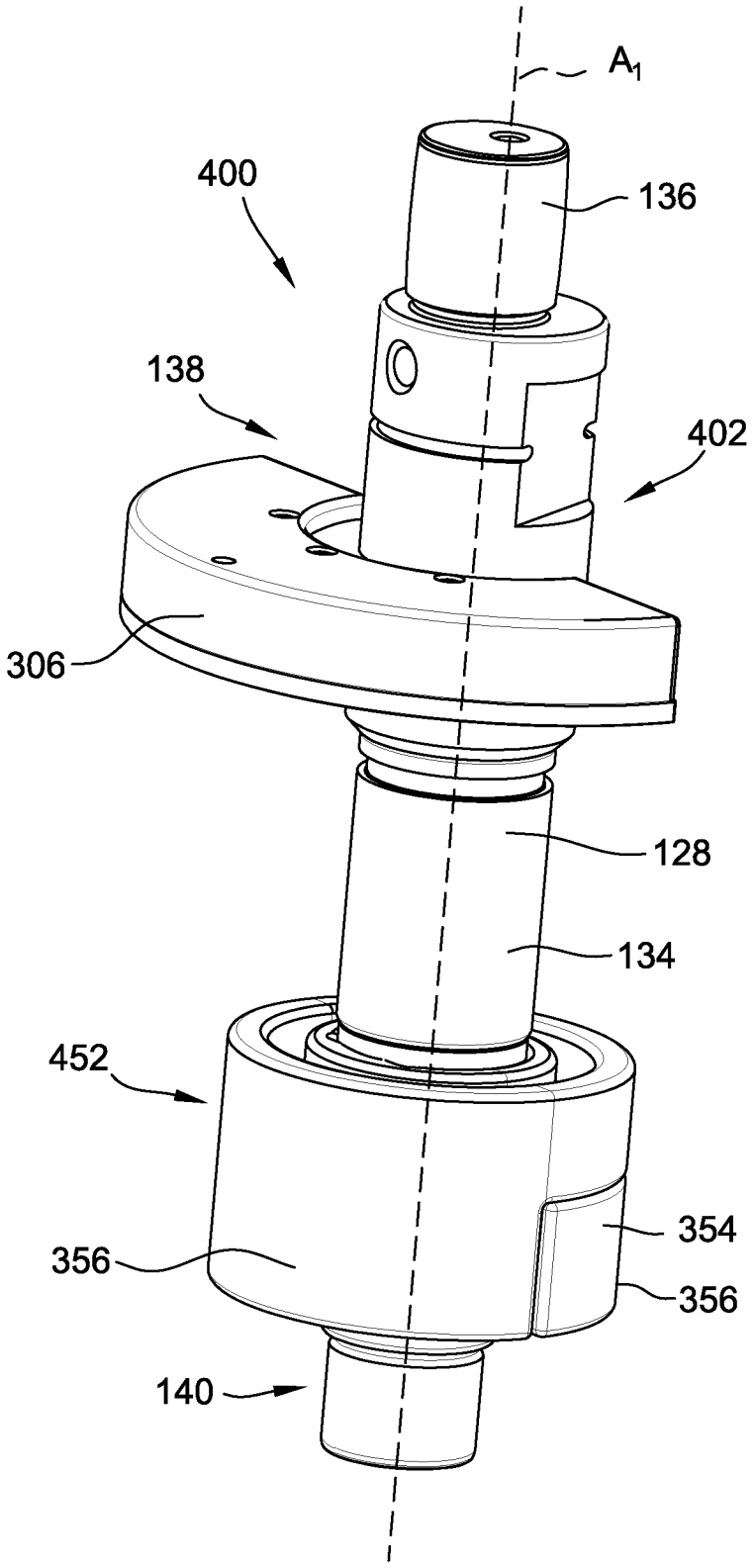
FIG. 19 is an isolated perspective of another example subassembly that includes the driveshaft and two counterweight assemblies.
Figure 20:
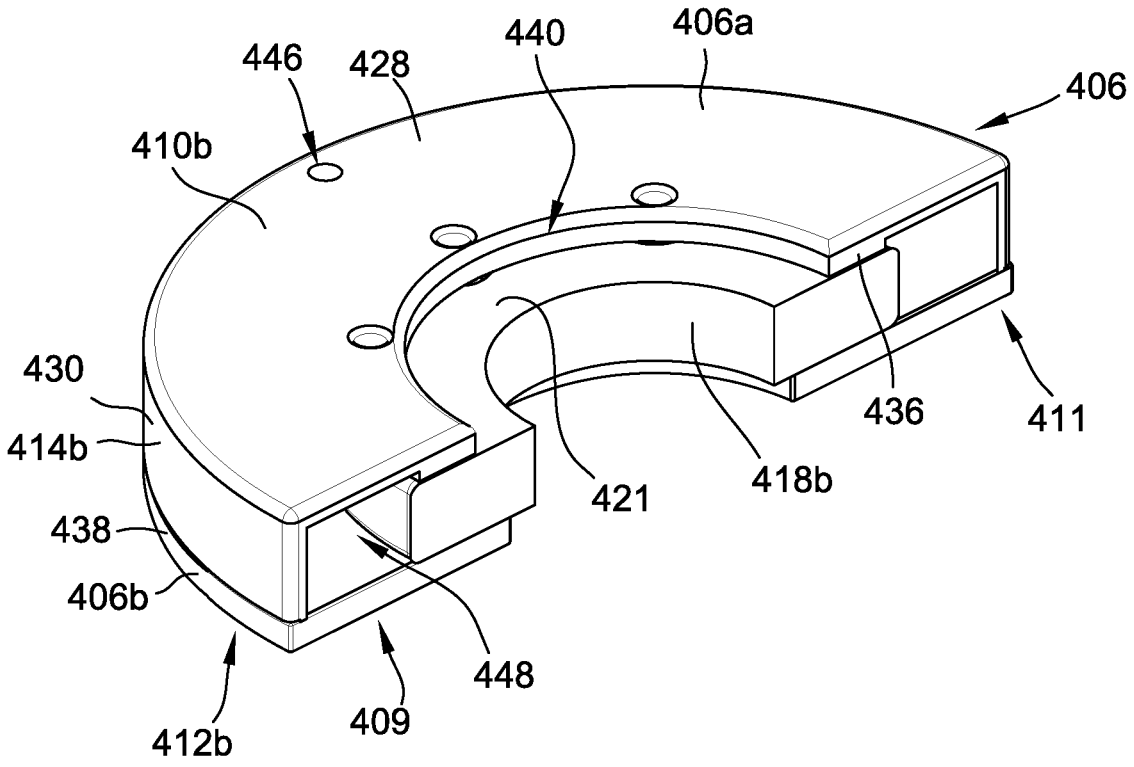
FIG. 20 is an isolated perspective of one of the counterweight assemblies of FIG. 19, with a portion of a counterweight omitted.
Figure 21:
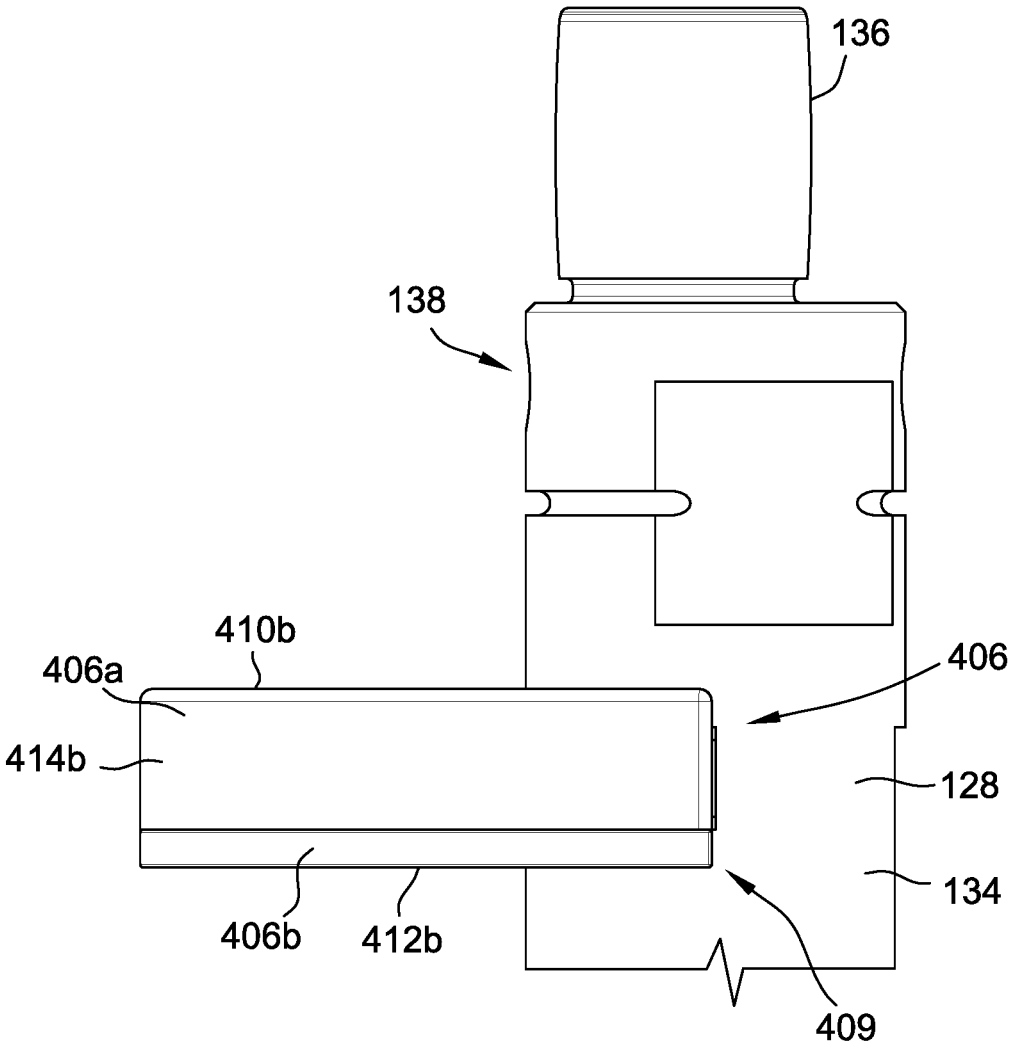
FIG. 21 is a side view of the counterweight assembly of FIG. 20 shown positioned on the driveshaft.

FIG. 19 depicts another example subassembly 400 that may be used in the compressor 100 (FIGS. 1-3) in lieu of the subassembly 180 (FIG. 4). The subassembly 400 includes the driveshaft 128 of the compressor 100 and two ring-shaped counterweight assemblies 402, 452 positioned on the driveshaft 128 at suitable locations, such as the locations described above for the counterweight assemblies 200, 250 and 302, 352.

Figure 28:
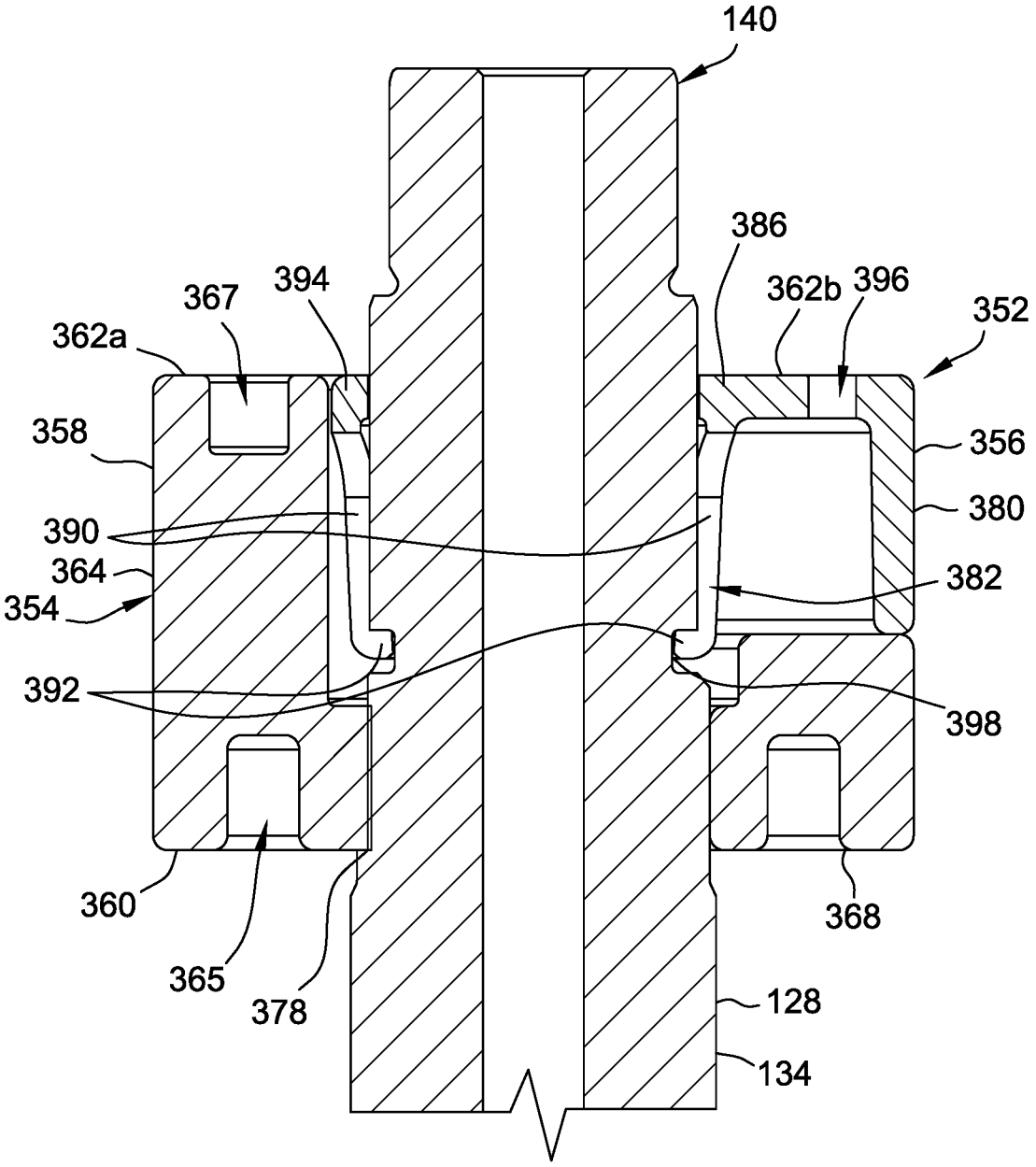
FIG. 28 is a section of the side view shown in FIG. 27.
Figure 29:
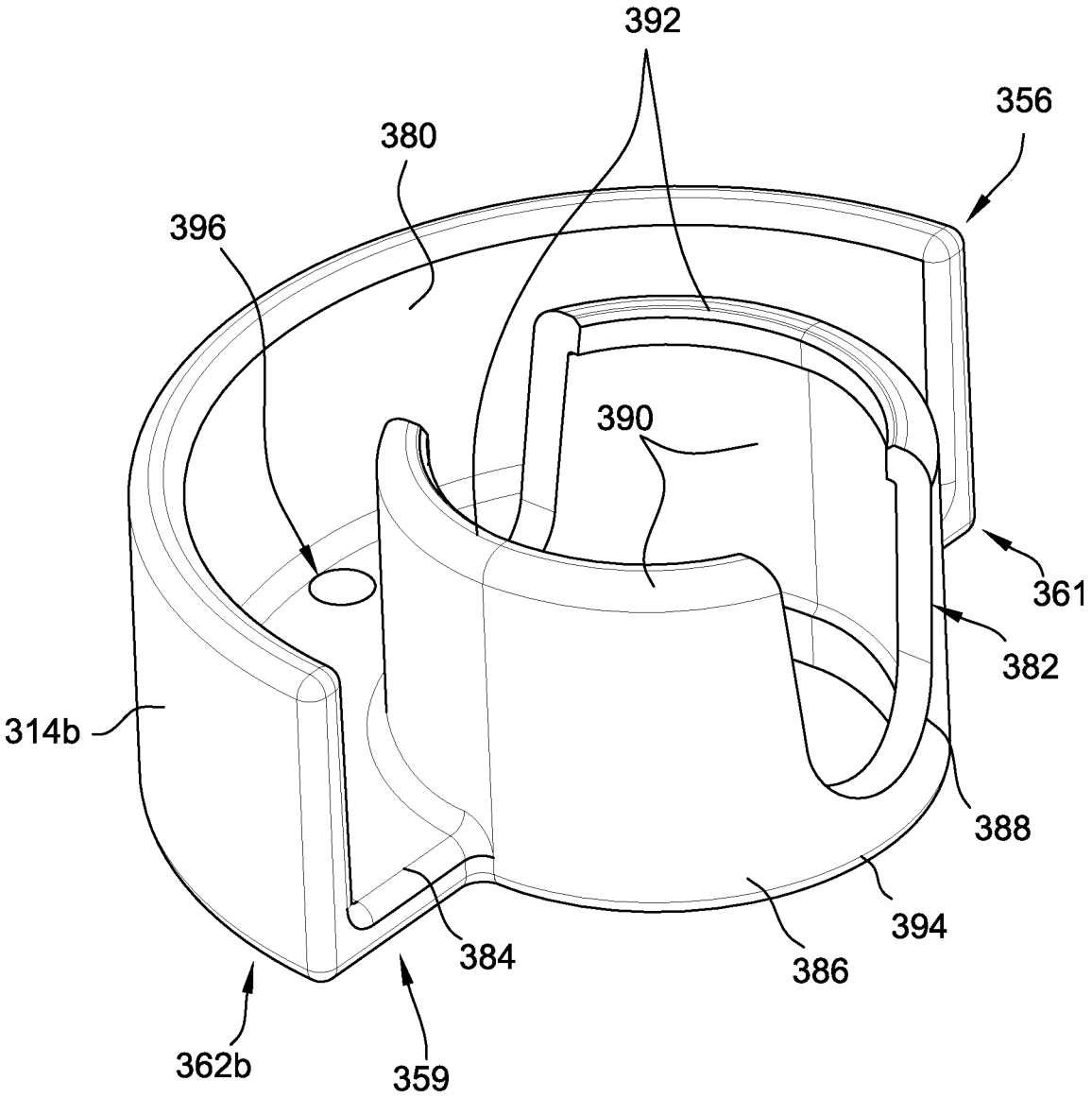
FIG. 29 is a bottom perspective of a cover of the counterweight assembly of FIG. 26.
Figure 30:
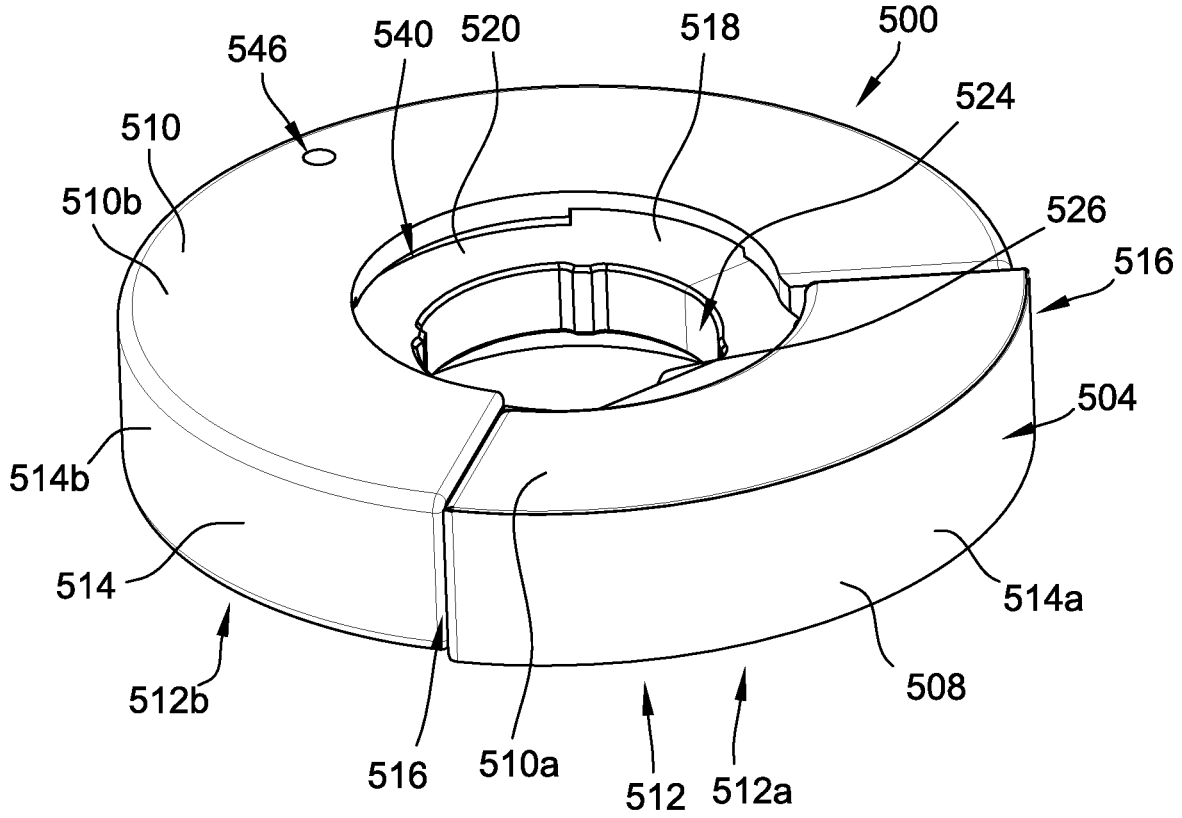
FIG. 30 is an isolated perspective of another example counterweight assembly.

A second counterweight assembly 452 (FIGS. 25-29) of the subassembly 400 is similar to the second counterweight assembly 352 described above with reference to FIGS. 15-18, and corresponding reference numerals are used to indicate corresponding elements and components between the counterweight assemblies 352, 452. In particular, the second counterweight assembly 452 includes in the counterweight 354 and the cover 356 as described above with reference to FIGS. 15-18. In the example second counterweight assembly 452, circumferential recesses 365, 367 are formed in the radial surfaces 360 and 362*a* of the counterweight 354, which may be used to control mass characteristics by removing material from the counterweight 354. The circumferential recess 367 is also included in the radial surface 362*a* in the second counterweight assembly 352 (shown in FIG. 17). Additionally, as shown in FIG. 28, in the example second counterweight assembly 452, the bulge 394 of the base 386 of the coupling collar 382 extends entirely to the radial surface 362*a* of the main weight 358, thereby substantially reducing a size of, or eliminating, the gap 363 therebetween (shown in FIG. 13) and limiting or restricting fluid from the chamber 122 flowing between the cover 356 and the counterweight 354.

Figure 25:
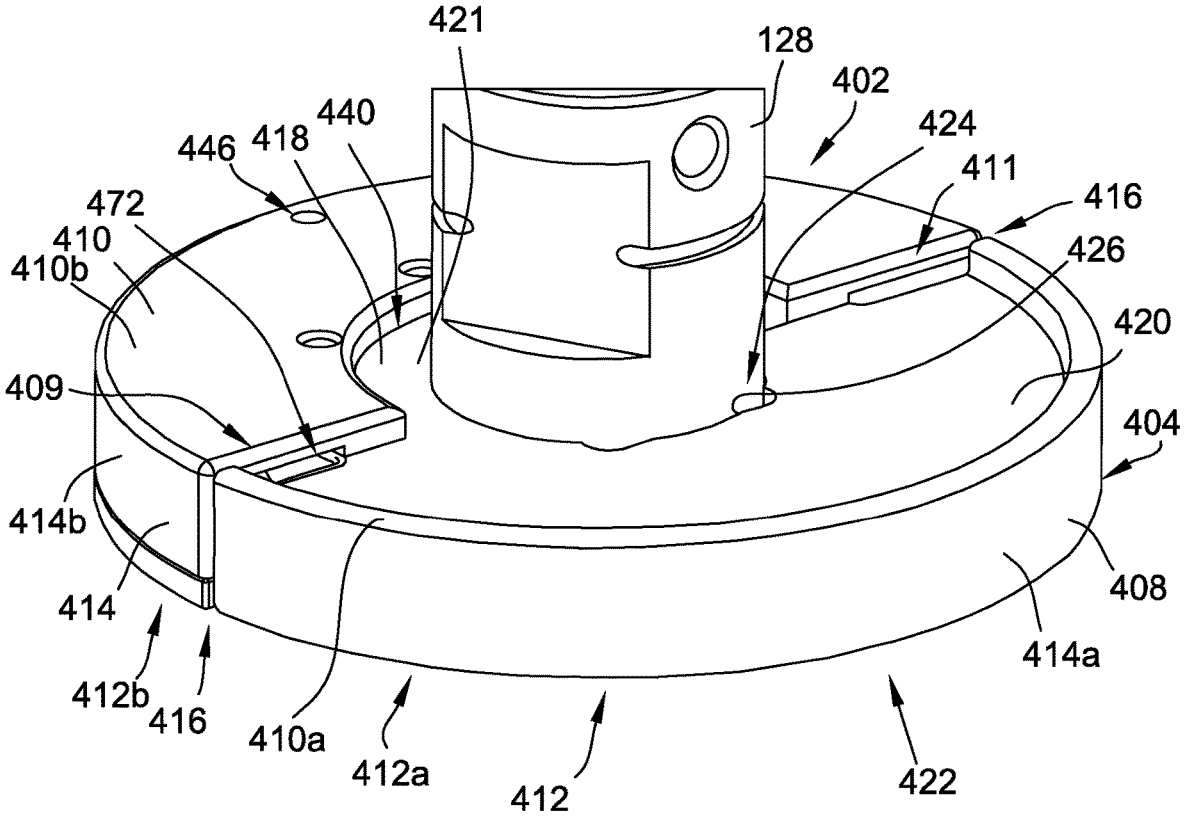
FIG. 25 is a perspective of the one of the counterweight assemblies of FIG. 19, shown partially in FIGS. 20-24, positioned on the driveshaft.
Figure 26:
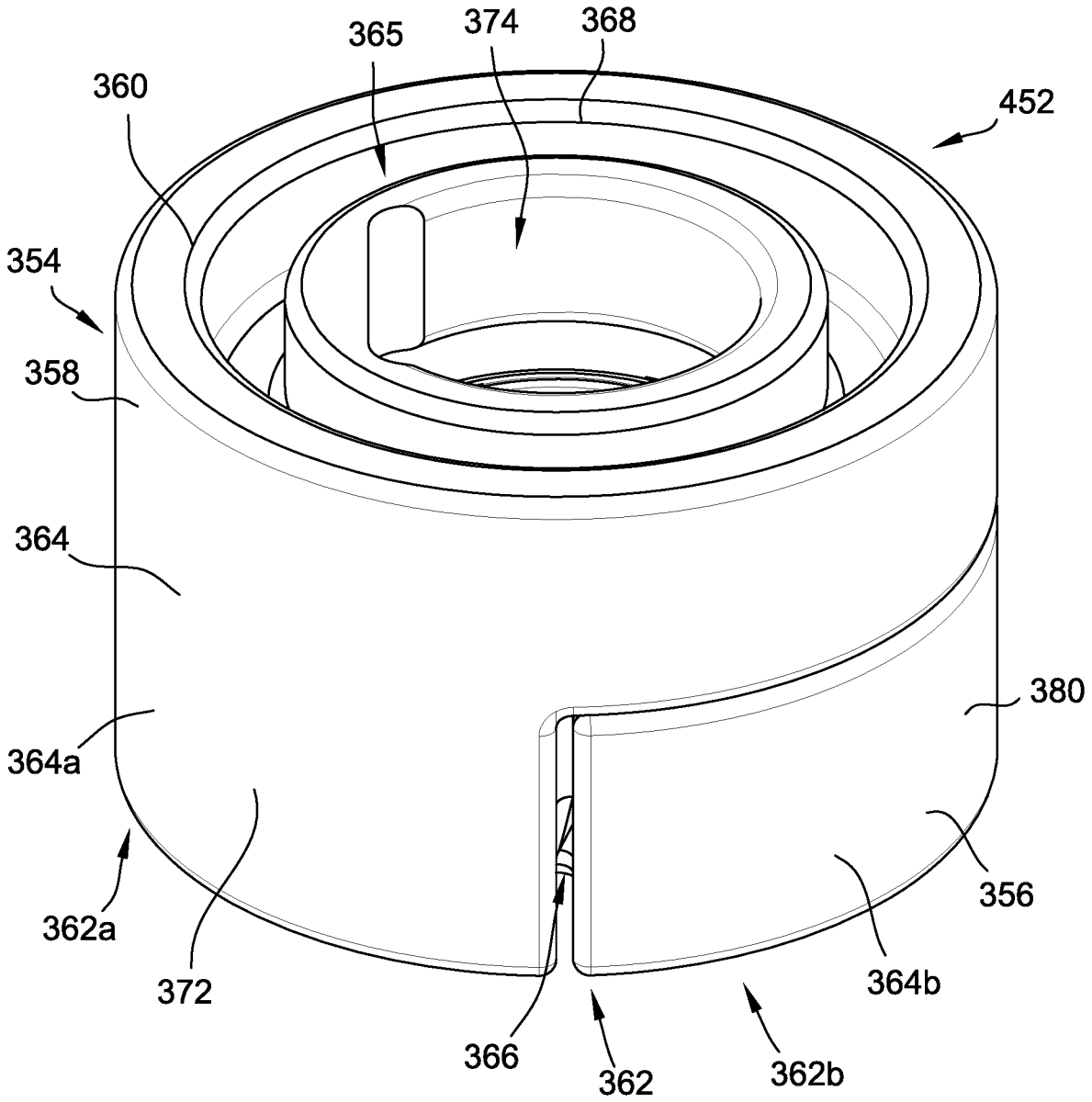
FIG. 26 is an isolated perspective of another one of the counterweight assemblies of FIG. 19.
Figure 27:
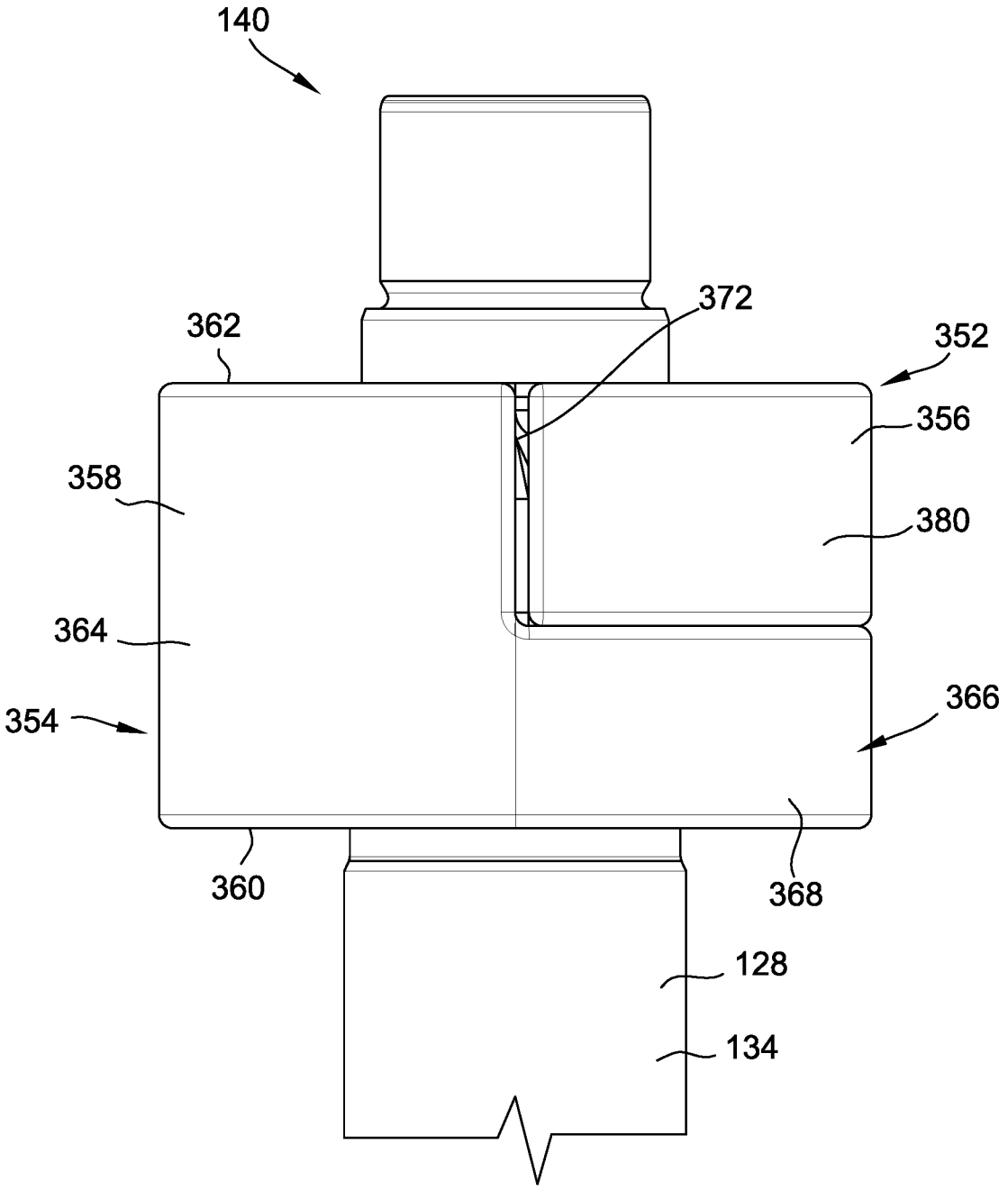
FIG. 27 is a side view of the counterweight assembly of FIG. 26 shown positioned on the driveshaft.

Referring to FIGS. 20-25, a first counterweight assembly 402 includes a counterweight 404 (shown fully in FIG. 25, shown partially in FIGS. 20-24) and a cover 406 that cooperate to form a disk-shape of the counterweight assembly 402. The counterweight 404 includes a semi-circular main weight 408 (shown in FIG. 25) that is sized and shaped to achieve desired mass characteristics and, as described above, may vary in size and shape depending on the intended application of the compressor 100 as well as the degree of balancing and load reduction required or desired from the counterweight 404. The counterweight 404, and the counterweight assembly 402, may have any suitable shape to enable the counterweight assembly 402 to function as described and as desired. Unless expressly stated otherwise or the context clearly indicates otherwise, the above-description of counterweights and the corresponding main weights applies to the counterweight 404, and the main weight 408.

The first counterweight assembly 402 includes two radial surfaces 410, 412, which are segmented into first radial surfaces 410*a*, 412*a* and second radial surfaces 410*b*, 412*b*, and a circumferential edge 414 segmented into a first circumferential edge 414*a* and a second circumferential edge 414*b*. The first radial surfaces 410*a*, 412*a* and the first circumferential edge 414*a* are defined by the main weight 408 and the second radial surfaces 410*b*, 412*b* and the second circumferential edge 414*b* are defined by the cover 406. The main weight 408 and the cover 406 each has a half-disk shape that defines the disk-shape of the first counterweight assembly 402, and the main weight 408 and the cover 406 are complementary in size such that a substantially smooth transition is provided at interfaces 416 defined between adjacent circumferential ends of the main weight 408 and the cover 406 at the circumferential edges 414*a*, 414*b*. The cover 406 and the main weight 408 each extend circumferentially between the interfaces 416 an arc length to cooperatively define a 360° circumferential extent. In the example first counterweight assembly 402, each of the cover 406 and the main weight 408 has an arc length of about 180°.

Steps 472 are formed at the interfaces 416 between the second radial surfaces 410*b*, 410*b* and stepped surfaces 420, 422 of the counterweight 404. The stepped surfaces 420, 422 are respectively recessed from the first radial surfaces 410*a*, 412*a* of the main weight 408. The stepped surfaces 420, 422 may be provided to control mass characteristics of the counterweight 404. The steps 472 may expose surface area at the circumferential ends 409, 411 of the cover 406. As such, the degree of the steps 472 may be selected to balance the desired mass characteristics of the counterweight 404 and the propensity for windage and drag on the exposed surface area at the circumferential cover ends 409, 411 from fluid in the chamber 122.

The first counterweight 404 is positioned on the driveshaft 128 using a coupling ring 418 that may be made integral with the main weight 408 as a one-piece unit or formed as two separate segments that are attached to one another. The coupling ring 418 includes a first segment 418*a* that defines the stepped surfaces 420, 422 of the counterweight 404. The first segment 418*a* terminates circumferentially at the interfaces 416. A second segment 418*b* of the coupling ring 418 extends circumferentially from the first segment 418*a* and completes a 360° circumferential extent of the coupling ring 418. The second ring segment 418*b* defines radial surfaces 421, 423 that are flush with the stepped surfaces 420, 422, respectively. The first and second ring segments 418*a*, 418*b* refer to two arcuate portions of the coupling ring 418 that may be made integral as a one-piece unit or may be attached using any suitable means for joining two components. The second ring segment 418*b* has a smaller outer diameter than the first ring segment 418*a*, such that the stepped surfaces 420, 422 extend radially outward beyond the radial surfaces 421, 423. The main weight 408 bounds the first ring segment 418*a* and the cover 406 bounds the second ring segment 418*b*. The second radial surfaces 410*b*, 412*b* extend radially inward from the circumferential edge 414*b* and terminate adjacent to or in close proximity with the radial surfaces 421, 423 of the second ring segment 418*b*. This reduces or eliminates gaps between the second radial surfaces 410*b*, 412*b* of the cover 406 and the radial surfaces 421, 423 of the second ring segment 418*b*. The steps 472 are defined at the interfaces 416 as described above. Semi-circular steps 440 are also defined between the second radial surfaces 410*b*, 412*b* of the cover 406 and the radial surfaces 421, 423 of the second ring segment 418*b*.

The coupling ring 418, like the above-described coupling rings 318 and 368, defines a central bore 424 that is sized and shaped to receive the driveshaft 128 and fix the first counterweight 404 on the driveshaft at the desired location. The coupling ring 418 may also define a flat 426 in the central bore 424 that complements an alignment notch 470

(FIG. 22) of the driveshaft 128, such as a keyway or groove, for positioning, aligning, and orienting the first counterweight 404 on the driveshaft 128.

In the first counterweight assembly 402, the cover 406 is formed of two half-disk-shaped shells 406*a*, 406*b* that cooperate to form the half-disk-shape of the cover 406. The shells 406*a*, 406*b* also facilitate attaching the cover 406 to the counterweight 404. The cover 406 attaches to the counterweight 404 such that the cover 406 and counterweight 404 can be installed on the driveshaft in a single step, rather than installing the components separately. In the example counterweight assembly 402, the cover 406 attaches to the second ring segment 418*b* of the coupling ring 418 via a snap fit connection, described in more detail below.

The first shell 406*a* includes a top platform 428, or top 428, that is semi-circular and defines the radial surface 410*b* of the cover 406, and a semi-circular skirt 430 extending downward from an outer periphery of the top 428. The skirt 430 defines the circumferential edge 414*b* of the cover 406. The first shell 406*a* also includes posts 432 extending downward from the top 428. The posts 432 are hollow and sized and shaped to engage with snap fittings 434 of second shell 406*b*, described below. The first shell 406*a* also includes an anti-vibration retainer 436 extending downward from an inner periphery of the top 428. The anti-vibration retainer 436 is a unitary structure in the illustrated example, but may be defined as a series of discrete protrusions or teeth in other examples. The retainer 436 is circumferentially coextensive with the top 428, and extends between the circumferential ends 409, 411 of the cover 406. In other examples, the retainer 436 may extend a shorter arc length than the top 428. The anti-vibration retainer 436 facilitates centering and maintaining the cover 406 on the second ring segment 418*b*, described further below. The top 428 may also include one or more drain holes 446 for fluid between the skirt 430 and the second ring segment 418*b* to exit.

The second shell 406*b* includes a bottom plate 438, or bottom 438, that has a complementing semi-circular shape to the top 428. The bottom 438 defines the second radial surface 412*b* of the cover 406 and a radial surface 439 opposite the surface 412*b*. The radial surface 439 engages a bottom of the skirt 430, opposite the top 428, when the cover 406 is assembled. The second shell 406*b* also includes the snap fittings 434, or "Christmas tree" snaps 434, extending upward from the radial surface 439 of the bottom 438. The snap fittings 434 are received by the posts 432 of the top 428. The snap fittings 434 define a snap fit connection within the posts 432 to attach the first shell 406*a* to the second shell 406*b*, thereby assembling the cover 406. In the example cover 406, there are three snap fittings 434 each received by one of three posts 432. Any suitable number of snap fittings 434 and a corresponding number of posts 432 may be included.

The bottom 438 also includes an arcuate slot 442 extending through the radial surfaces 439 and 412*b*. The slot 442 receives a tail 444 of the top 428 that extends downward from the skirt 430 when the cover 406 is assembled. The tail 444 is also arcuate in shape, complementing a shape of the slot 442, and the tail 444 defines a snap fit connection within the slot 442 to retain the top 428 and bottom 438 relative to one another. The slot 442 and the tail 444 are positioned at an outer periphery of the bottom 438 and the skirt 430, respectively, and extend an arc length that is shorter that the arc length of the top 428 and bottom 438 such that the slot 442 and tail 444 each terminate prior to the circumferential ends 409, 411 of the cover 406. In other examples, the slot 442 and the tail 444 may extend substantially the same arc length as the top 428 and the bottom 438. In yet other examples, a series of discrete slots 442 and a corresponding series of discrete tails 444 that each receive one of the slots 442 may be included.

The two shells 406*a*, 406*b* of the cover 406 cooperate to define a mouth 448 of the cover 406 that presents a hollow interior of the cover 406. The second ring segment 418*b* is at least partially received by the mouth 448 and seated in the hollow interior of the cover 406. The semi-circular shape of the shells 406*a*, 406*b* is such that an inner periphery of the top 428 and bottom 438 complements an inner peripheral shape of the second ring segment 418*b* and such that the top 428 and bottom 438 do not interfere with the central bore 424 of the coupling ring 418. In the illustrated example, as described above, the radial surfaces 421, 423 of the second ring segment 418*b* extend radially inward from the radial surfaces 410*b*, 412*b* of the cover 406 such that the steps 440 are defined therebetween. A portion of the radial surfaces 421, 423, radially outward from the steps 440, are covered by the top 428 and the bottom 438. To facilitate centering and maintaining the cover 406 relative to the second ring segment 418*b*, the radial surface 439 of the bottom 438 engages the radial surface 423 of the second ring segment 418*b* and the anti-vibration retainer 436 of the top 428 engages the radial surface 421 of the second ring segment 418*b*.

The snap connection between the shells 406*a*, 406*b* also facilitates attaching the cover 406 to the second ring segment 418*b*. The second ring segment 418*b* includes holes 450 that each receive one of the posts 432 of the first shell 406*a*. When the cover 406 is assembled and attached to the second ring segment 418*b*, the posts extend from the top 428, through the holes 450 of the second ring segment 418*b*, and to the bottom 438 to receive the snap fittings 434 of the second shell 406*b*.

Figure 22:
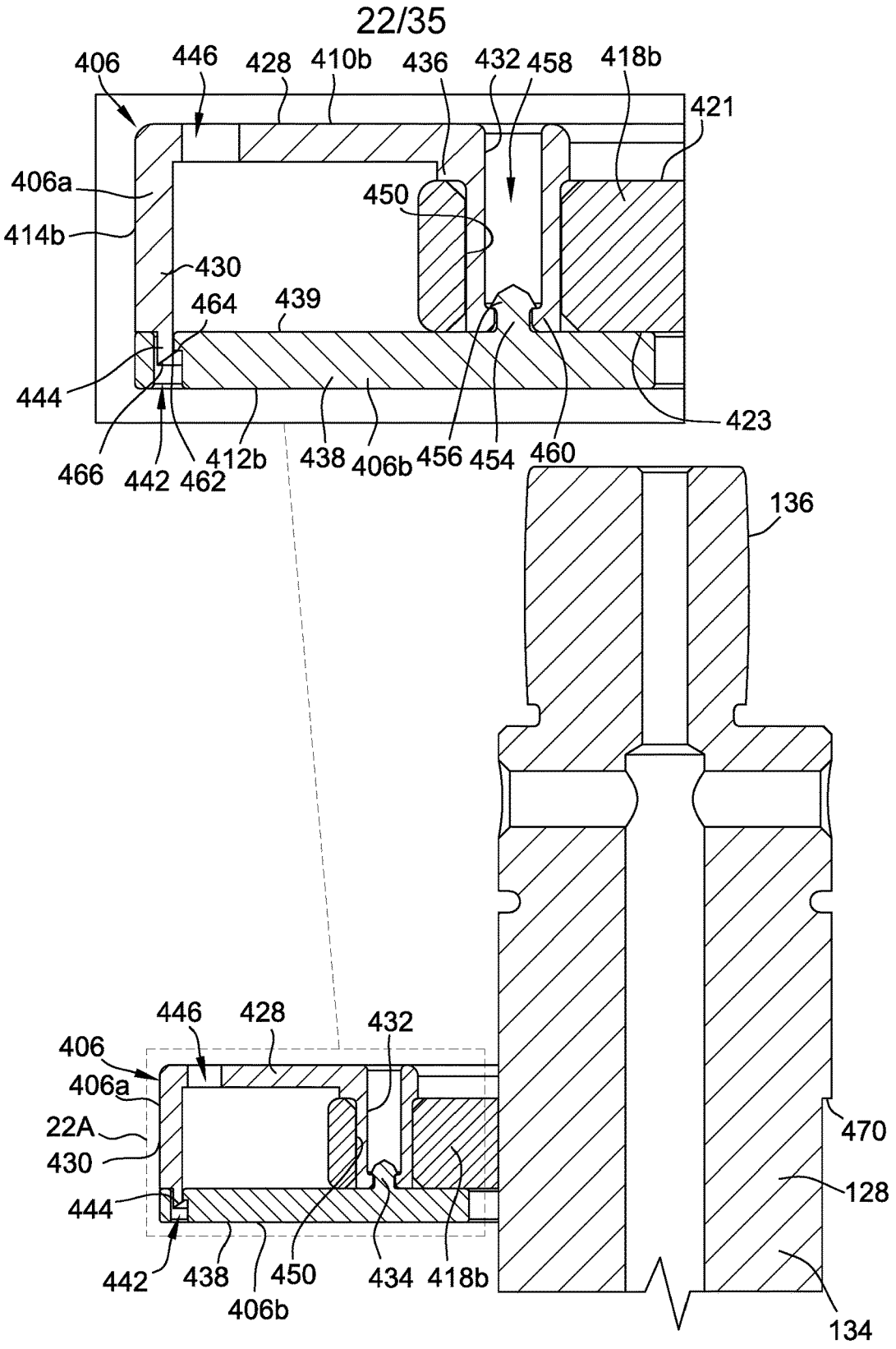
FIG. 22 is a section of the side view shown in FIG. 21 and includes an enlarged view of Section 22A.
Figure 23:
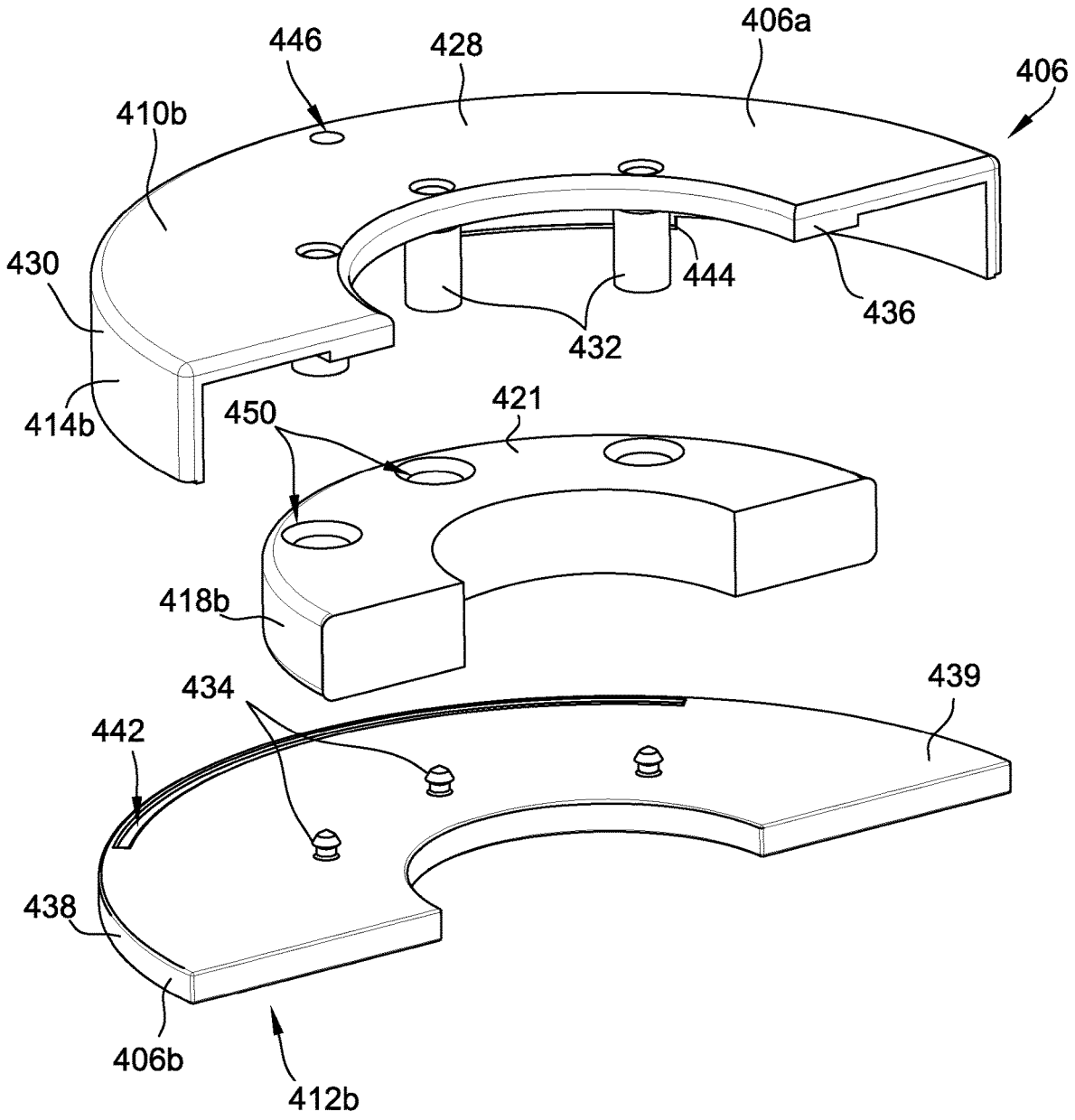
FIG. 23 is an exploded view of the counterweight assembly of FIG. 20.
Figure 24:
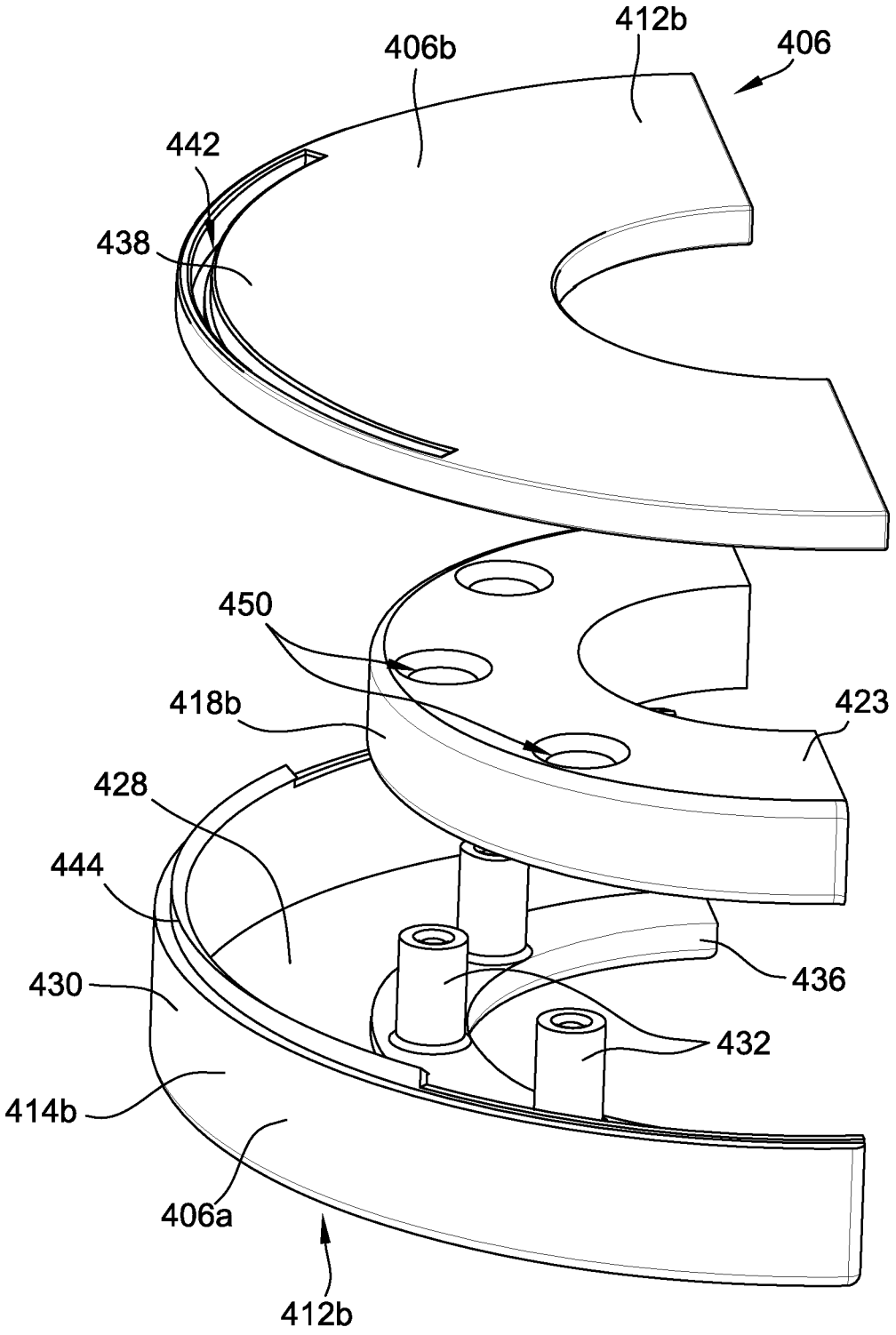
FIG. 24 is an inverted exploded view of the counterweight assembly of FIG. 20.

FIG. 22 includes an enlarged Section 22A and depicts the snap connections to assemble the cover 406 and attach the cover 406 to the second ring segment 418*b* in greater detail. Each snap fitting 434 has a "Christmas tree" shape with a trunk 454 extending from the radial surface 439 of the bottom and a head 456 extending from the trunk 454 and flared outward relative to the trunk 454. The posts 432 are hollow and define internal channels 458, and the snap fittings 434 are received by the internal channels 458 of the posts 432. The channels 458 have a reduce inner diameter at an end 460 opposite the top 428. The heads 456 of the snap fittings 434 are pressed through and engage the reduced diameter end 460 of the posts 432 to define the snap fit connection, and the trunks 454 are positioned within the reduced diameter end 460 of the channel 458. The posts 432, which extend through the holes 450 of the second ring segment 418*b*, may extend downward from the anti-vibration retainer 436 of the first shell 406*a* which engages the radial surface 421 of the second ring segment 418*b*. The radial surface 439 of the bottom 438 engages the radial surface 423 of the second ring segment 418*b*. The snap fit connection between the snap fittings 434 and the posts 432 extending through the holes 450 of the second ring segment 418*b* and the engagement between the anti-vibration retainer 436 and the bottom 438 and the second ring segment 418*b* facilitates attaching, centering, and maintaining connection between the cover 406 and the second ring segment 418*b*. The engagement between the anti-vibration retainer 436 and the bottom 438 and the second ring segment 418*b* may also facilitate limiting or restricting fluid from the chamber 122 from accumulating between the cover 406 and the second ring segment 418*b*. The drain holes 446 in the top 428 also provide an exit for any fluid that accumulates between the cover 406 and the second ring segment 418*b*.

The tail 444 is cantilevered from the skirt 430 and articulates relative to the skirt 430 when received by the slot 442 of the bottom 438. The tail 444 includes a stop 462 that engages a groove 464 of the slot 442 to form the snap fit connection. The tail 444 may also include a leading edge 466 that is angled to facilitate piloting the tail 444 into the slot 442.

Advantages of the subassembly 400 described above with reference to FIGS. 19-29 include, but are not limited to only including, advantages similar to those a)-f) described above for the subassembly 300 with respect to the second counterweight assembly 352, and/or g) providing flexibility in attaching the cover 406 to the counterweight 404 such that the counterweight assembly 402 can be sub-assembled and installed on the driveshaft 128 as a single unit and/or the cover 406 can be attached to and detached from the counterweight 404 after the driveshaft 128 and motor assembly 118 are assembled within the compressor 100, h) reducing windage that may otherwise be produced by cover attachment features, for example, flexible fingers of a coupling collar used to attach a counterweight assembly cover to the driveshaft, i) providing centering features (e.g., anti-rotation retainer 436) and engaging surfaces (e.g., the radial surface 439 of the bottom 438 and the radial surface 423 of the second ring segment 418*b*) that facilitate centering and maintaining connection between the cover 406 and the counterweight 404, j) providing snap fit connections (e.g., between snap fittings 434 and posts 432 and between slot 442 and tail 444) that provide quick and efficient assembly of the cover 406 and attachment of the cover 406 to the counterweight 404, k) eliminating the need to attach the cover 406 to the driveshaft 128, which eliminates the need for machined grooves or other features on the driveshaft 128, l) providing orientation features (e.g., holes 450 in the second ring segment 418*b* and posts 432 of the top 428) that facilitate orienting and attaching the cover 406 to the counterweight 404, and/or m) providing supplementary connections (e.g., snap fit connection between the slot 442 and tail 444) that reduce vibration and maintain assembly of a two-piece cover 406.

FIGS. 30-34 depict another example counterweight assembly 500 that may be included in any of the subassemblies 180, 300, and 400 described above. The counterweight assembly 500 includes a counterweight 504 and a cover 506 that cooperate to form a disk-shape of the counterweight assembly 500. The counterweight 504 includes a semi-circular main weight 508 that is sized and shaped to achieve desired mass characteristics and, as described above, may vary in size and shape depending on the intended application of the compressor 100 as well as the degree of balancing and load reduction required or desired from the counterweight 504. The counterweight 504, and the counterweight assembly 500, may have any suitable shape to enable the counterweight assembly 500 to function as described and as desired. Unless expressly stated otherwise or the context clearly indicates otherwise, the above-description of counterweights and the corresponding main weights applies to the counterweight 504, and the main weight 508.

The counterweight assembly 500 includes two radial surfaces 510, 512, which are segmented into first radial surfaces 510*a*, 512*a* and second radial surfaces 510*b*, 512*b*, and a circumferential edge 514 segmented into a first circumferential edge 514*a* and a second circumferential edge 514*b*. The first radial surfaces 510*a*, 512*a* and the first circumferential edge 514*a* are defined by the main weight 508 and the second radial surfaces 510*b*, 512*b* and the second circumferential edge 514*b* are defined by the cover 506. The main weight 508 and the cover 506 each has a semi-ring (e.g., semi-disk) shape that cooperatively define the ring-shape (e.g., disk-shape) of the counterweight assembly 500, and the main weight 508 and the cover 506 are complementary in size such that a substantially smooth transition is provided at interfaces 516 between the circumferential edges 414*a*, 414*b*, the radial surfaces 510*a*, 510*b*, and the radial surfaces 512*a*, 512*b*. One interface 516 is defined between a circumferential end 513 of the main weight 508 and an adjacent circumferential end 509 of the cover 506, and the other interface 516 is defined between a circumferential end 515 of the main weight 508 and an adjacent circumferential end 511 of the cover 506. The cover 506 and the main weight 508 each extend circumferentially between the interfaces 516 an arc length to cooperatively define a 360° circumferential extent. In the example counterweight assembly 500, the main weight 408 has an arc length less than 180°, and the cover 506 corresponding has an arc length that is greater than 180°.

The counterweight 504 is positioned on a driveshaft (e.g., the driveshaft 128) using a coupling ring 518 that may be made integral with the main weight 508 as a one-piece unit or formed as two separate segments that are attached to one another. The coupling ring 518 defines radial surfaces 520, 522 of the counterweight 504 that are stepped from the radial surfaces 510, 512, respectively, forming steps 540. The coupling ring 518 has a first segment 518*a* that terminates circumferentially at the interfaces 516. A second segment 518*b* of the coupling ring 518 extends circumferentially from the first segment 518*a*, beyond the circumferential ends 513, 515, and completes a 360° circumferential extent of the coupling ring 518. The main weight 508 protrudes from both radial surfaces 520, 522 along outer periphery of the first ring segment 518*a*. The second ring segment 518*b* includes two arcuate ridges 521, 523 each protruding from an outer periphery of the radial surfaces 520, 522, respectively. The ridges 521, 523 have an arc length that is shorter than the arc length of the second ring segments 518*b*, such that each ridge 521, 523 is circumferentially spaced from the circumferential ends 513, 515 of the main weight 508. The first and second ring segments 518*a*, 518*b* refer to two arcuate portions of the coupling ring 518 that may be made integral as a one-piece unit or may be attached using any suitable means for joining two components. When the counterweight assembly 500 is assembled, the main weight 508 bounds the first ring segment 518*a* and the cover 506 bounds the second ring segment 518*b*. The coupling ring 518, like the above described coupling rings 318, 368, and 418, defines a central bore 524 that is sized and shaped to receive a driveshaft (e.g., the driveshaft 128) and fix the counterweight 504 on the driveshaft at the desired location. The coupling ring 518 may also define a flat 526 in the central bore 524 that complements an alignment notch (not shown) of a driveshaft, such as a keyway or groove, for positioning, aligning, and orienting the counterweight 504 on the driveshaft.

In the counterweight assembly 500, the cover 506 is a one-piece unit that includes a semi-ring-shaped (e.g., semi-disk-shaped) shell 502 having a hollow interior 550 (shown in FIG. 34) and a mouth 548 that presents the hollow interior 550 opposite the circumferential edge 514*b*. The shell 502 attaches to the counterweight 504 such that the cover 506 and counterweight 504 can be installed on the driveshaft in a single step, rather than installing the components separately. In the example counterweight assembly 500, the cover 506 attaches to the second ring segment 518*b* of the coupling ring 518 via a snap fit connection, described in more detail below. The one-piece shell 502 may be made as a one-piece unit using injection molding or additive manufacturing, for example. Alternatively, the shell 502 may be constructed from two or more pieces that are joined together (e.g., using ultrasonic welding). In these examples, each piece of the shell 502 may be made using injection molding or additive manufacturing. In some of these examples, the shell 502 is made from two identical pieces that are joined together (e.g., using ultrasonic welding).

The shell 502 includes a top platform 528, or top 528, and a bottom platform 538, or bottom 538, that are each semi-circular and extend circumferentially between the circumferential ends 509, 511 of the cover 506. A semi-circular skirt 530 extends between the top 528 and the bottom 538 and joins the top 528 and the bottom 538 at their outer periphery. The top 528 defines the radial surface 510*b* of the cover 506, the bottom 538 defines the radial surface 512*b*, and the skirt 530 defines the circumferential edge 514*b* of the cover 506. The top 528 defines an interior radial surface 529 and the bottom 538 defines an interior radial surface 539 that faces the radial surface 529 of the top 528.

Figure 34:
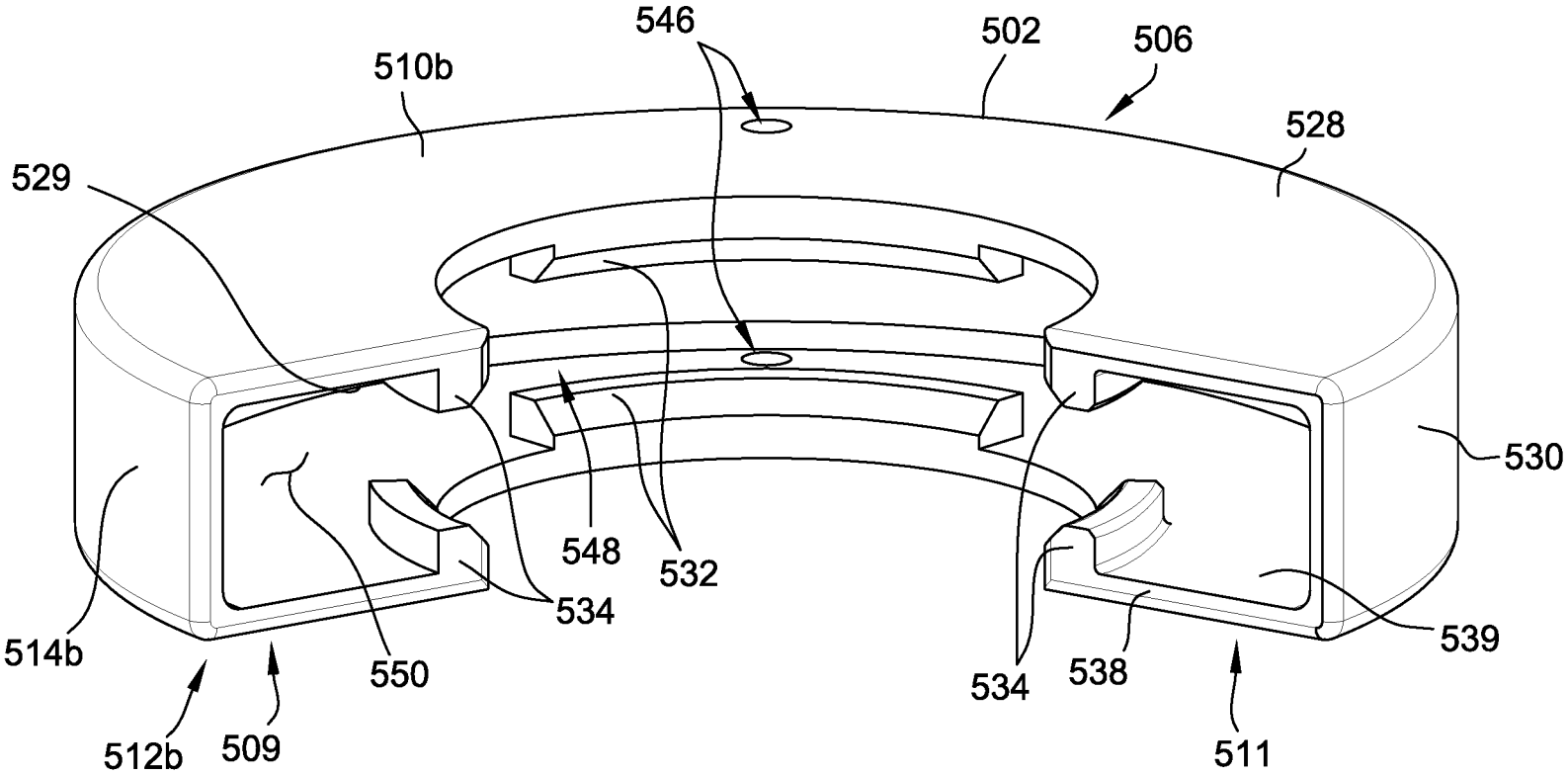
FIG. 34 is an isolated perspective of a cover of the counterweight assembly of FIG. 30.

The shell 502 also includes teeth 532 and anti-vibration retainers 534 extending from the radial surfaces 529, 539 at an inner periphery of the top 528 and bottom 538. As shown in FIG. 34, the tooth 532 extending from the top 528 is at a corresponding angular location as the tooth 532 extending from the bottom 538. The teeth 532 are located circumferentially inboard of the circumferential ends 509, 511 and spaced circumferentially from the anti-vibration retainers 534. The anti-vibration retainers 534 extending from the top 528 are at corresponding angular locations as the anti-vibration retainers 534 extending from the bottom 538. One pair of corresponding anti-vibration retainers 534 of the top 528 and bottom 538 extend adjacent the circumferential end 509, and the other pair of corresponding anti-vibration retainers 534 extend adjacent the circumferential end 511. The tooth 532 and anti-vibration retainers 534 extending from the top 528 may be defined by a discontinuous ridge extending downward from the inner periphery of the top 528. Similarly, the tooth 532 and anti-vibration retainers 534 extending from the bottom 538 may be defined by a discontinuous ridge extending upward from the inner periphery of the bottom 538. In some examples, the teeth 532 and anti-vibration retainers 534 may be defined by unitary ridges, one ridge extending downward from the inner periphery of the top 528 and one ridge extending upward from the inner periphery of the bottom 538. The teeth 532 each engage one of the ridges 521, 523 of the second ring segment 518*b*, described further below, to connect the cover 506 to the counterweight via the snap fit connection. The anti-vibration retainers 534 each engage one of the radial surfaces 520, 522 of the second ring segment 518*b*. The anti-vibration retainers 534, like the anti-vibration retainers 436 described above, facilitate centering and maintaining the cover 506 on the second ring segment 518*b*. The corresponding angular locations of the teeth 532 and anti-vibration retainers 534 may create a mirror-image construction of the shell 502 which enables the shell 502 to be connected to the second ring segment 518*b* when in the orientation shown in FIG. 34 and when inverted 180°.

The top 528 and bottom 538 each also include one or more drain holes 546 for fluid between the skirt 530 and the second ring segment 518*b* to exit. The drain holes 546 may also be formed at corresponding angular locations on the top 528 and bottom 538, such that the shell 502 has the mirror-image construction described above.

Figure 31:
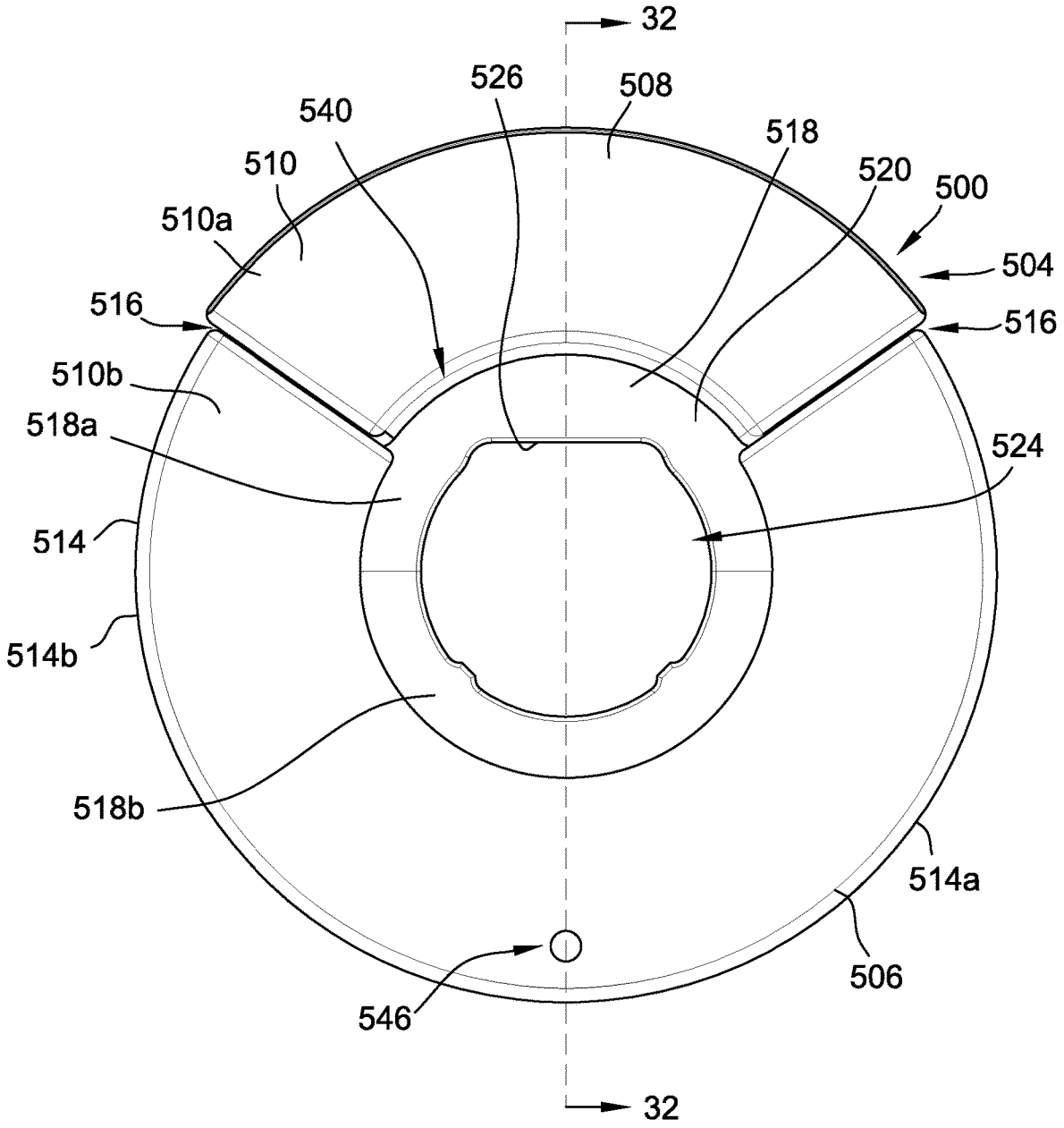
FIG. 31 is a top view of the counterweight assembly of FIG. 30.
Figure 32:
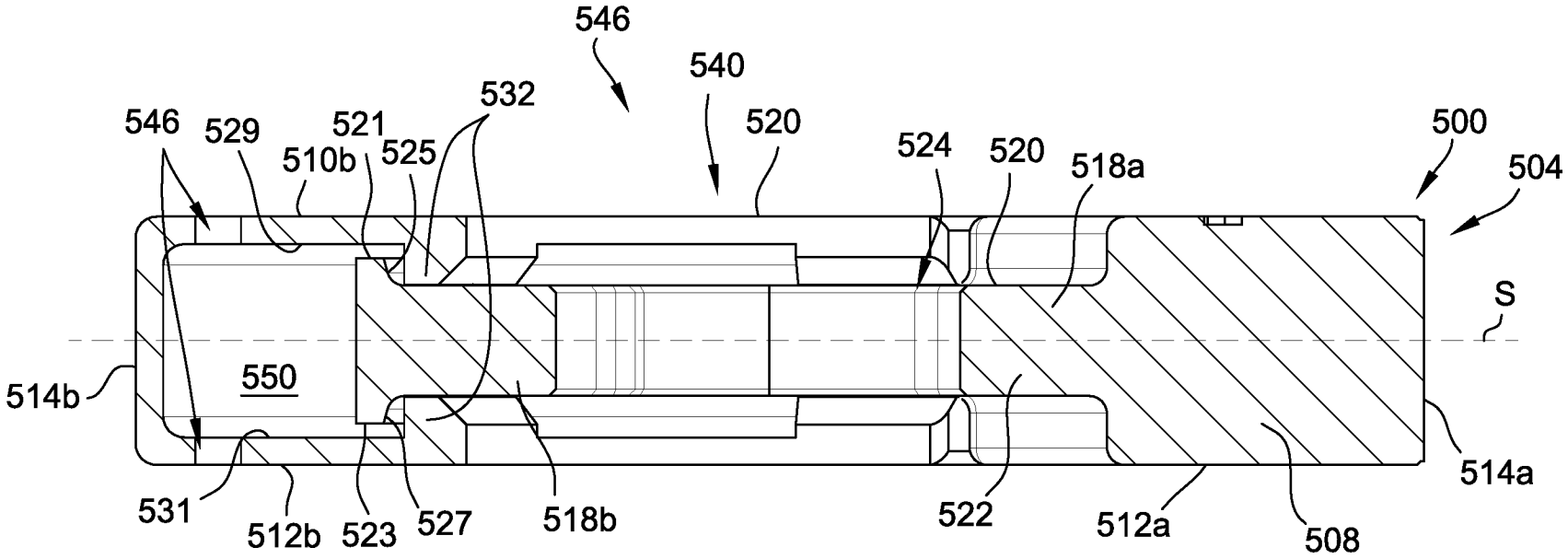
FIG. 32 is a section taken along line 32-32 in FIG. 31.
Figure 33:
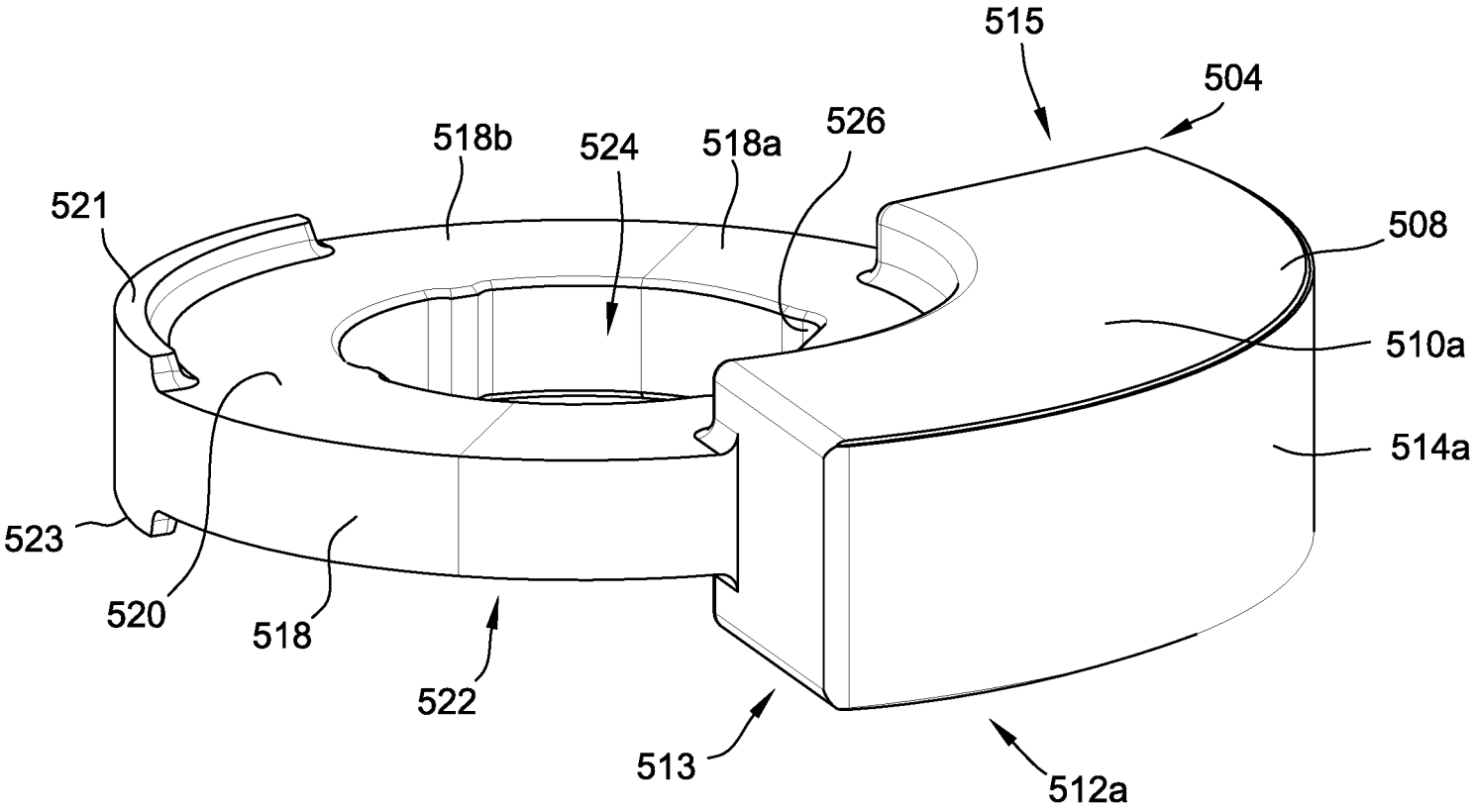
FIG. 33 is an isolated perspective of a counterweight of the counterweight assembly of FIG. 30.

FIG. 32 is a cross-section of the counterweight assembly 500 taken along line 32-32 of FIG. 31, and shows the mirror-image construction of the counterweight assembly 500. In particular, the counterweight 504 and the cover 506 define a plane of symmetry S. When the counterweight assembly 500 is positioned on a driveshaft (e.g., the driveshaft 128), the plane of symmetry S intersects (i.e., is perpendicular to) a longitudinal axis (e.g., the longitudinal axis $A_1$) of the driveshaft. In this way, the counterweight assembly 500 can be installed on the driveshaft when in the orientation shown in FIG. 32 and when inverted 180°.

As described above, the shell 502 may be made as a one-piece unit or may be constructed from two or more pieces that are joined together (e.g., using ultrasonic welding). In the latter examples, the shell 502 may be constructed of two identical pieces that are joined (e.g., using ultrasonic welding) along the plane of symmetry S. In such examples, the two pieces of the shell 502 may be made using injection molding or additive manufacturing.

FIG. 32 also depicts the snap fit connection between the cover 506 and the counterweight 504 and, more particularly, the snap fit connection defined between the teeth 532 of the shell 502 and the ridges 521, 523 of the second ring segment 518*b*. When the counterweight assembly 500 is assembled, the top 528 and the bottom 538 each extend over (radially inward beyond) the ridges 521, 523, and the teeth 532 each engage stop surfaces 525, 527 respectively defined by the ridges 521, 523. The mouth 548 and hollow interior 550 of the shell 502 allow the shell 502 to flex or articulate about the skirt 530, temporarily deflecting the top 528 and bottom 538 away from one another to bring the teeth 532 over the ridges 521, 523. The teeth 532 then "snap" over the ridges 521, 523, into engagement with the stop surfaces 525, 527 to form the snap fit connection. The anti-vibration retainers 534 are also brought into engagement with each one of the radial surfaces 520, 522 of the second ring segment 518*b* to facilitate centering and maintaining the cover 506 on the second ring segment 518*b* as described above.

Figure 35:
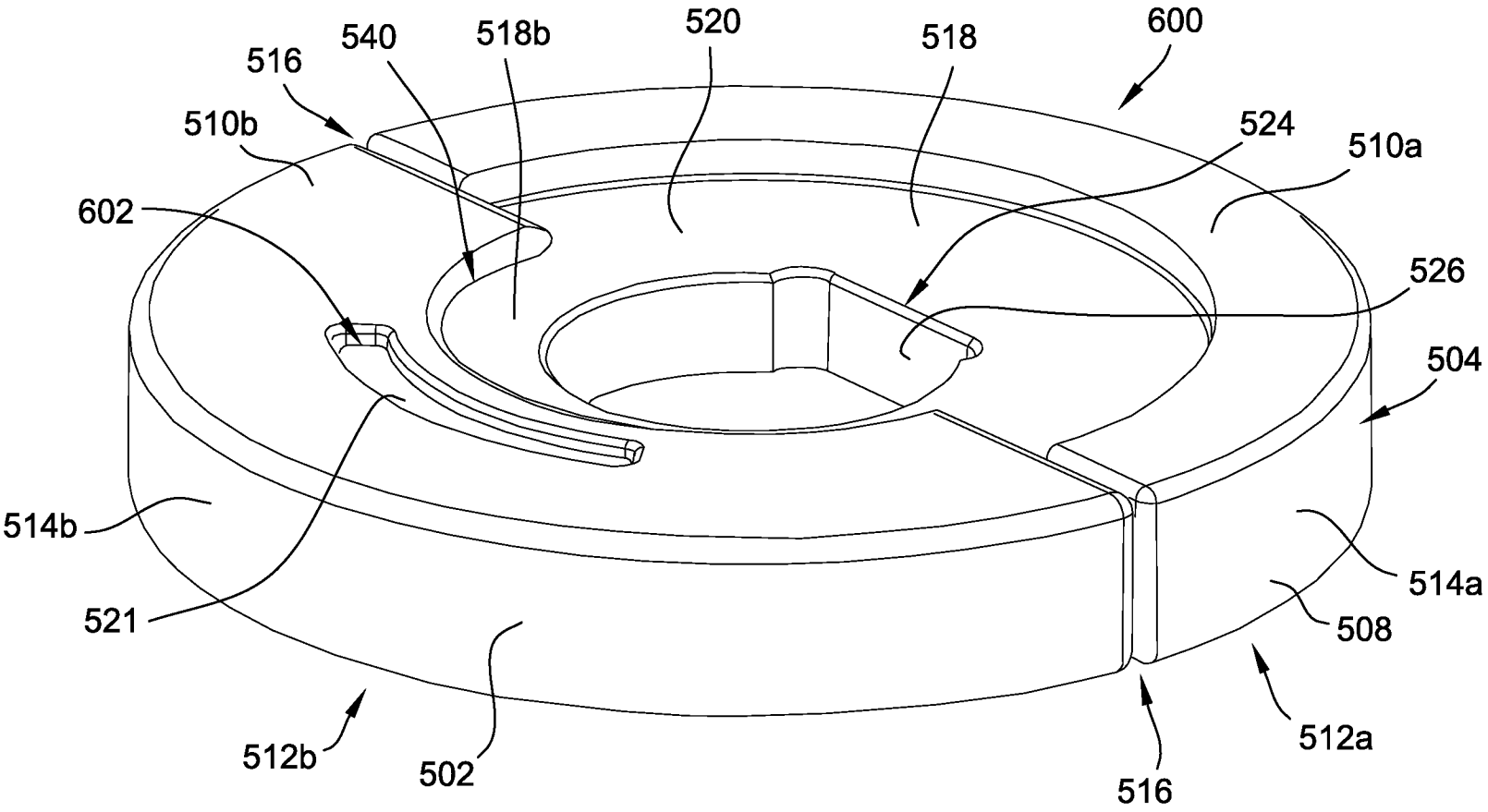
FIG. 35 is an isolated perspective of another example counterweight assembly.

FIG. 35 is an alternative example of a counterweight assembly 600 which is similar to the counterweight assembly 500 described above with reference to FIGS. 30-34 and includes the cover 506 that connects to the counterweight 504 via a snap fit connection. As described above the cover 506 includes the shell 502, and the counterweight includes the second ring segment 518*b* having the ridges 521, 523 described above. The main weight 508 of the counterweight 506 has a longer circumferential extent or arc length in this example (e.g., about) 180°, and the cover 506 correspondingly has a shorter circumferential extent or arc length. Additionally, in lieu of the teeth 532 and anti-vibration retainers 534, the top 528 and bottom 538 of the shell 502 each include arcuate slots 602 that receive the ridges 521, 523 (only the arcuate slot 602 in the top 528 is shown in FIG. 35). Similar to the above-description for the counterweight assembly 500, in this example, the shell 502 flexes or articulates about the skirt 530, temporarily deflecting the top 528 and bottom 538 away from one another to bring the slots 602 over the ridges 521, 523. The ridges 521, 523 then "snap" into the slots 602 to form the snap fit connection. The interior radial surfaces 529, 539 of the shell 502 (FIGS. 32 and 34) may engage the radial surfaces 520, 522 of the second ring segment 518*b* in face-to-face contact. The engagement between the radial surfaces 529, 539 and the radial surfaces 520, 522 may facilitate limiting or restricting fluid from the chamber 122 from entering the hollow interior 550 of the shell 502 between the second ring segment 518*b* and may omit the need for drain holes in the cover 506. However, in some examples, the cover 506 of the counterweight assembly 600 may include drain holes (e.g., drain holes 546).

Advantages of the counterweight assemblies 500 and 600 described above with reference to FIGS. 30-35 include, but are not limited to only including, advantages similar to those g)-m) described above for the counterweight assembly 402, and/or n) reducing the number of parts of the cover 506, o) reducing the amount of material needed for the cover 506, p) eliminating the need for holes in the counterweight 504 to form the snap fit connection with the cover 506, q) increasing the flexibility and the variability of counterweight designs that are usable with the cover 506, r) providing an invertible or mirror-image design of the cover 506 that can be installed in multiple orientations, s) providing a reliable snap fit connection between the cover 506 and counterweight while also enabling the cover 506 to be readily removable from the counterweight, and/or t) providing flexibility in attaching the cover 506 to the counterweight 504 such that the counterweight assembly 500, 600 can be sub-assembled and installed on the driveshaft 128 as a single unit and/or the cover 506 can be attached to and detached from the counterweight 504 after the driveshaft 128 and motor assembly 118 are assembled within the compressor 100.

In the above examples, various counterweight assemblies 200, 250, 302, 352, 402, 452, 500, 600 are described. These counterweight assemblies can be used in any combination in the subassembly 180 of the compressor 100. In the example counterweight assemblies 200, 250, 302, 352, 402, 452, 500, 600, the counterweight is suitably made of a material with a relatively higher density, such as a metal material, and the cover is suitably made of a material with a relatively lower density, such as a plastic. In the various example counterweight assemblies, the counterweight may be made of a metal die-cast material or an extruded metal material. Any materials suitable for use as a counterweight in a scroll compressor can be used for the counterweights. The covers of the counterweight assemblies 200, 250, 302, 352, 402, 452, 500, 600 are suitably made of a plastic material that is capable of forming an injection molded or additively manufactured material. In certain embodiments, the covers of the counterweight assemblies 200, 250, 302, 352, 402, 452, 500, 600 are made of a thermoplastic polymer, such as acrylonitrile butadiene styrene for example.

When introducing elements of the present disclosure or the embodiment(s) thereof, the articles "a", "an", "the," and "said" are intended to mean that there are one or more of the elements. The terms "comprising," "including," "containing," and "having" are intended to be inclusive and mean that there may be additional elements other than the listed elements.

"Optional" or "optionally" means that the subsequently described event or circumstance may or may not occur, and that the description includes instances where the event occurs and instances where it does not.

References to "one embodiment" or "an embodiment" are not intended to be interpreted as excluding the existence of additional embodiments that also incorporate the recited features. Moreover, although specific features of various embodiments described herein may be shown in some drawings and not in others, this is for convenience only. In accordance with the principles of the present disclosure, any feature of a drawing and/or embodiment described herein may be referenced and/or claimed in combination with any feature of any other drawing and/or embodiment described herein.

Approximating language, such as "generally," "substantially," and "about," as used herein indicates that the term so modified may apply to only an approximate degree, as would be recognized by one of ordinary skill in the art, rather than to an absolute or perfect degree. Accordingly, a value modified by a term or terms such as "about," "approximately," and "substantially" is not to be limited to the precise value specified. In at least some instances, the approximating language may correspond to the precision of an instrument for measuring the value. Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item.

As various changes could be made in the above constructions and methods without departing from the scope of the disclosure, all matter contained in the above description and shown in the accompanying drawing(s) shall be interpreted as illustrative and not in a limiting sense.

What is claimed is:

1. A compressor comprising:
- a shell;
- a non-orbiting scroll disposed within the shell;
- an orbiting scroll disposed within the shell and meshed with the non-orbiting scroll;
- a driveshaft operable to drive the orbiting scroll relative to the non-orbiting scroll; and
- a ring-shaped counterweight assembly positioned on the driveshaft and having two radial surfaces and a circumferential edge between the two radial surfaces, wherein the counterweight assembly comprises:
  - a counterweight fixed on the driveshaft, the counterweight including a coupling ring and a main weight extending from the coupling ring, the coupling ring defining a bore sized and shaped to receive the driveshaft to fix the counterweight on the driveshaft, wherein the main weight has a semi-circular shape with two circumferential counterweight end surfaces; and
  - a cover attached to the coupling ring via a snap fit connection, wherein the counterweight and the cover cooperate to define the counterweight assembly, wherein the cover extends circumferentially between two cover end surfaces each positioned adjacent one of the counterweight end surfaces, wherein the cover includes:
    - (i) a shell defining a mouth that receives the coupling ring; and
    - one of:
      - teeth that engage ridges on two radial surfaces of the coupling ring to form the snap fit connection; or
      - slots that receive ridges on two radial surfaces of the coupling ring to form the snap fit connection; or
    - (ii) a multi-piece shell comprising a top and a bottom and defining a mouth that receives the coupling ring, wherein the top and the bottom are connected via snap fittings extending through the coupling ring.

2. The compressor of claim 1, wherein the main weight and the cover cooperatively bound the coupling ring in a circumferential direction and the two radial surfaces of the coupling ring are stepped from the radial surfaces of the counterweight assembly.

3. The compressor of claim 1, wherein the cover includes anti-vibration retainers that each engage one of the two radial surfaces of the coupling ring.

4. The compressor of claim 1, wherein the cover and the main weight define a plane of symmetry that intersects a longitudinal axis of the driveshaft.

5. The compressor of claim 1, wherein the shell defines one or more drain holes.

6. The compressor of claim 1, wherein the counterweight assembly defines a first counterweight assembly, wherein the compressor further comprises a second ring-shaped counterweight assembly positioned on the driveshaft to counterbalance an inertial force of the first counterweight assembly, the second counterweight assembly having two radial surfaces and a circumferential edge between the two radial surfaces, wherein the second counterweight assembly comprises:

a second counterweight fixed on the driveshaft; and a second cover attached to one of the second counterweight and the driveshaft via a snap fit connection, wherein the second counterweight and the second cover cooperate to define the second counterweight assembly.

7. A subassembly for a scroll compressor, the subassembly comprising:

a driveshaft;

a first counterweight assembly positioned proximate a first end portion of the driveshaft; and a second counterweight assembly positioned proximate a second end portion of the driveshaft, wherein each counterweight assembly is ring-shaped, having two radial surfaces and a circumferential edge between the two radial surfaces, and comprises:

a counterweight fixed on the driveshaft, the counterweight including a coupling ring and a main weight extending from the coupling ring, the coupling ring defining a bore sized and shaped to receive the driveshaft to fix the counterweight on the driveshaft, wherein the main weight has a semi-circular shape with two circumferential counterweight end surfaces; and a cover attached to the coupling ring via a snap fit connection, wherein the counterweight and the cover cooperate to define the respective counterweight assembly, wherein the cover extends circumferentially between two cover end surfaces each positioned adjacent one of the counterweight end surfaces; and wherein, for at least one of the first and second counterweight assemblies, the cover includes:

a shell defining a mouth that receives the coupling ring; and one of:

teeth that engage ridges on two radial surfaces of the coupling ring to form the snap fit connection; or slots that receive ridges on two radial surfaces of the coupling ring to form the snap fit connection.

8. The subassembly of claim 7, wherein, for one of the first and second counterweight assemblies, the cover is attached to the coupling ring of the counterweight via the snap fit connection and includes a multi-piece shell comprising a top and a bottom and defining a mouth that receives the coupling ring, wherein the top and the bottom are connected via snap fittings extending through the coupling ring.

9. The subassembly of claim 7, wherein, for at least one of the first and second counterweight assemblies, the cover is attached to the coupling ring of the counterweight via the snap fit connection and includes anti-vibration retainers that each engage one of the two radial surfaces of the coupling ring.

10. The subassembly of claim 7, wherein, for at least one of the first and second counterweight assemblies, the cover and the main weight define a plane of symmetry that intersects a longitudinal axis of the driveshaft.

11. A method of assembling a compressor, the method comprising:

positioning a non-orbiting scroll within a shell of the compressor;

positioning an orbiting scroll within the shell such that the orbiting scroll is meshed with the non-orbiting scroll;

operably connecting a driveshaft to the orbiting scroll;

positioning a ring-shaped counterweight assembly on the driveshaft by driveshaft, the counterweight assembly having two radial surfaces and a circumferential edge between the two radial surfaces, the counterweight assembly including:

a counterweight including a coupling ring and a main weight extending from the coupling ring, the coupling ring defining a bore sized and shaped to receive the driveshaft, the main weight having a semi-circular shape with two circumferential counterweight end surfaces; and a cover extending circumferentially between two cover end surfaces and including a shell and one of teeth or slots, wherein the counterweight and cover cooperate to define the counterweight assembly:

fixing the counterweight on the driveshaft; and attaching the cover to the coupling ring using a snap fit connection such that the coupling ring is received within a mouth of the shell and the two cover end surfaces are each positioned adjacent one of the counterweight end surfaces, wherein the snap fit connection is formed by one of:

the teeth engaging ridges on two radial surfaces of the coupling ring; or the slots receiving ridges on two radial surfaces of the coupling ring.

12. The method of claim 11, wherein the cover is attached to the counterweight using the snap fit connection before positioning the counterweight assembly on the driveshaft.

13. The method of claim 11, wherein the cover is attached to the counterweight using the snap fit connection after fixing the counterweight on the driveshaft.

* * * * *